US005369892A

United States Patent [19]

Dhaemers

[11] Patent Number: 5,369,892

[45] Date of Patent: Dec. 6, 1994

[54] ARMOIRE

[76] Inventor: Gregory L. Dhaemers, 829 N. 27th Ave. West, Duluth, Minn. 55806

[21] Appl. No.: 72,151

[22] Filed: Jun. 4, 1993

[51] Int. Cl.[5] ..... F26B 19/00

[52] U.S. Cl. ..... 34/275; 34/60; 34/224; 34/74

[58] Field of Search ..... 34/133 J, 133 K, 133 L, 34/133 M, 133 B, 133 E, 60, 73, 74, 76, 82, 4, 151, 202, 218, 219, 220, 221, 222, 223, 224–225, 232, 275

[56] References Cited

U.S. PATENT DOCUMENTS

| | | | |
|---|---|---|---|
| 2,221,351 | 11/1940 | Kempf . | |
| 2,232,022 | 2/1941 | Drake . | |
| 3,256,616 | 6/1966 | McGoldrick . | |
| 3,513,564 | 5/1970 | Gramprie . | |
| 3,626,602 | 12/1971 | Glowacki | 34/151 |
| 3,670,425 | 6/1972 | Benjamin . | |
| 3,739,487 | 6/1973 | Clark . | |
| 3,805,561 | 4/1974 | Bullock . | |
| 3,858,331 | 1/1975 | Lord | 34/151 |
| 3,877,152 | 4/1975 | Gorman | 34/133 B |
| 4,145,602 | 3/1979 | Lee . | |
| 4,180,919 | 1/1980 | Baltes . | |
| 4,471,537 | 9/1984 | Meda . | |
| 4,625,432 | 12/1986 | Baltes . | |
| 4,677,764 | 7/1987 | Cerny . | |
| 4,682,424 | 7/1987 | Irving . | |
| 4,869,872 | 9/1989 | Baltes . | |
| 5,152,077 | 10/1992 | Liang . | |

*Primary Examiner*—Henry A. Bennett
*Attorney, Agent, or Firm*—Burd, Bartz & Gutenkauf

[57] ABSTRACT

A dryer has an internal drying chamber for accommodating articles that are subjected to a heated circulating air to remove moisture from the articles. An air mixing chamber contains a first fan for moving air through a heater into the drying chamber. A second fan draws air out of the drying and mixing chambers and discharges air through a filter into the external environment. The heated air in the drying chamber is mixed with fresh air and recirculated through the drying chamber to minimize heat losses and increase drying effectiveness. Ultraviolet lamps within the drying chamber destroy contaminants in the air and articles within the chamber. A boot dryer, located in the drying chamber, has fans that move air through tubes used to support boots, shoes, skates and socks. Ultraviolet light in the boot chamber destroy contaminants in the air in the boot chamber. One modification of the dryer located within a locker room is used to remove moisture and odors from the air in the locker room. The dryer has a dehumidifier for cooling and removing moisture from the air, a heater coil for heating the air, ultraviolet lights for destroying contaminants and a charcoal filter for removing odors from the air flowing out of the dryer. Another modification of the dryer has a portable housing supporting a heater and a fan for moving air through filters and a drying chamber.

62 Claims, 13 Drawing Sheets

ARMOIRE

FIELD OF INVENTION

The invention is in the field of dryers for drying clothing, sporting and athletic equipment. The drying is achieved by circulating heated air in an enclosed chamber accommodating the articles to be dried.

BACKGROUND OF INVENTION

Wet outdoor garments, sport clothing and equipment have in the past been stored in garages, back rooms and basements where they would eventually dry due to natural air circulation. The natural air circulation is not conducive to rapid drying of articles. The damp articles, such as clothing, will mildew and have unpleasant odors when stored without adequate drying. Cloth drying machines having housings with drying chambers have been used for drying clothes. These machines have heating elements and fans for circulating hot air within the drying chambers to dry the clothes placed in the drying chambers. An example of this type of drying machine is shown by C. J. Liang in U.S. Pat. No. 5,152,077. The machine has a housing having a drying chamber for accommodating clothes. Heated air moving through the drying chamber carries moisture out of the drying chamber into a condensing compartment where moisture is condensed into water and then delivered to an evaporating apparatus and converted into steam. The steam is dried by an electric heater and moved back into the drying chamber. An ultraviolet light is located within the drying chamber for sterilizing the clothes in the drying chamber. Other machines having drying chambers for accommodating heated air for drying clothing are disclosed by A. Irving in U.S. Pat. No. 4,682,424 and J. W. McCormick in U.S. Pat. No. 1,755,013.

SUMMARY OF INVENTION

The invention is directed to a self-contained dryer having an internal chamber for accommodating articles, such as clothing, sporting equipment, hockey gear, shoes and other objects. The dryer has a housing enclosing a drying chamber in which the articles are dried and stored. Doors attached to the housing permit access to the interior of the chamber. Heated air is directed with a first fan into the drying chamber simultaneously with the discharge of air from the drying chamber with a second fan which draws fresh air into the drying chamber and discharges air to the outside of the dryer. The heated air is recirculated in the drying chamber to increase its moisture content so that the dryer has effective, energy-efficient characteristics. Filters, such as charcoal filters, located adjacent air inlets and outlets, remove airborne odors and particulates from the air moving into and out of the dryer.

The dryer is equipped with a boot dryer, located within the drying chamber. The boot dryer has at least one additional fan that draws air from the drying chamber and discharges the air through tubular members extended into mittens, gloves or footwear, including boots and shoes. The additional fans also recirculate the air in the drying chamber. Ultraviolet lights located in the chamber are used to decontaminate the air.

The dryer is adapted to accommodate damp and wet articles of clothing, hunting and sporting equipment including boots, shoes and socks and efficiently and effectively drying these articles. The dryer has a generally upright housing having an internal drying chamber for accommodating the articles to be dried. A pair of doors, hinged to the front of the housing, can be moved to open positions to permit access into the drying chamber so that the articles can be conveniently placed in the drying chamber. The doors are pivoted to their closed positions to enclose the drying chamber. The dryer can have a single door. The drying chamber has a generally horizontal ceiling, which forms with the top wall of the housing and air mixing chamber. Separate portions of the ceiling are provided with openings to allow air to flow from the air mixing chamber into the drying chamber and out of the drying chamber back into the air mixing chamber. An air heater, located in the air mixing chamber, is used to heat air that is supplied to the drying chamber. The heater can be an electric heating coil, an infrared lamp or other devices used to heat air. A first fan operated with an electric motor is located in the air mixing chamber adjacent the heater. The fan operates to move air from the mixing chamber into the heater and hot air from the heater into the drying chamber. The air is directed downwardly into the drying chamber where it accumulates moisture from the articles located within the chamber. A second fan, located within the air mixing chamber, operates to draw air from the drying chamber and outside air into the drying chamber and discharge air into the environment outside of the dryer through filters containing charcoal or material to reduce odors from the air. The first and second fans operate concurrently to continuously circulate and recirculate the air in the drying chamber. The filters contain activated charcoal or materials which removes odors from the air flowing into and out of the dryer. Ultraviolet light fixtures mounted on the ceiling emit UV light that sterilizes the air and articles located within the drying chamber.

A casing, having an internal chamber, is located within the drying chamber to dry mittens, gloves and boot wear, including boots, shoes, skates, in-line roller blade-type skates, socks and the like. A plurality of tubular pipes or members are mounted on the casing and open to the internal chamber of the casing to deliver air into the articles mounted on the tubes. A pair of third fans mounted on the casing operate to move air from the drying chamber through the internal chamber of the casing and tubes to dry the articles thereon. A second ultraviolet lamp, located within the internal chamber, directs UV light through the tubes into the articles mounted thereon to destroy bacteria, fungus, mildew and other contaminants present in the air and article on the tube.

The heater and fans are controlled with a plurality of switches and a timer used to select the operating cycle of the dryer. A coin-operated mechanism can be used to control the timer. The control includes a switch connected to germicidal ultraviolet lights located within the drying chamber for sterilizing and decontaminating the air and articles within the drying chamber. All of the fans are under the control of a single switch so that the fans concurrently operate to move air into and out of the drying chamber, as well as to recirculate the air in the drying chamber. The air discharged from the dryer has a high moisture content resulting in high energy drying efficiency.

The heated air source for the dryer can be a hot air furnace or an external heating system. The exhaust air is discharged into the return air ducts directly back into the room, or to the outside of the room. The exhaust air can be directed through a carbon filter back into the room containing the dryer. A series of dryers can be connected to the central heating and return air duct system or ducts and filters to direct air back into the room.

A first modification of the dryer draws air into the boots and discharges air through charcoal filters outside of the boot dryer. This dryer has a casing supporting a tray for collecting water, snow, ice and dirt and upright tubes for accommodating articles to be dried. A fan within the casing draws air into the tubes and discharges air through charcoal filters externally of the boot dryer. An ultraviolet lamp within the casing emits UV light through the tubes into the articles on the tubes. Mirrors associated with the tubes reflect UV light laterally into the articles.

A second modification of the dryer is used within a room, such as a locker room, to remove moisture and odors from the air in the room. The dryer has a dehumidifier having a first coil for cooling air and removing moisture from the air and a second coil for heating the dried air. A blower draws cool air from the chamber having the first coil and discharges air through the second coil and a charcoal filter into the room having the dryer. An ultraviolet light emits UV light into the air leaving the second coil to decontaminate the air and filter.

A third modification of the dryer is a portable structure useable in closets and rooms for drying and storing articles. The dryer has flexible side, front and back walls that surround a drying chamber. The walls fold down into a bottom member to facilitate transport, handling and storage of the entire dryer. A top member attached to the walls has hooks that fit over a horizontal support bar to locate the dryer in the extended position of a closet or room. A motor-driven fan mounted on a horizontal interior wall draws air through an air inlet filter mounted on the top member and discharges air into a duct extending to the bottom area of the drying chamber. The duct can be attached to a boot dryer supported on the bottom member whereby air is directed into the boot dryer. The boot dryer has a plurality of upright tubes that direct air into the drying chamber or articles mounted on the tubes.

A fourth modification of the dryer is a chest or foot locker-type structure that is portable for use in and away from home. Articles, such as sports gear, can be stored and dried in the dryer. The dryer has a housing enclosing a drying chamber. The housing is attached to wheels and a handle to facilitate manual handling of the dryer. The top of the drying chamber is closed with a cover hinged to the housing. The cover is movable to an open position to allow access to the drying chamber. A motor-driven fan located in an air mixing chamber draws air through a heater and discharges hot air through a filter into the drying chamber. Air porous walls within the drying chamber allow air to flow from the drying chamber back to the air mixing chamber for recirculation back into the drying chamber. The air also flows out of the drying chamber through a filter, such as an activated charcoal filter which removes odors from the air.

DESCRIPTION OF PREFERRED EMBODIMENTS

Figure 1:
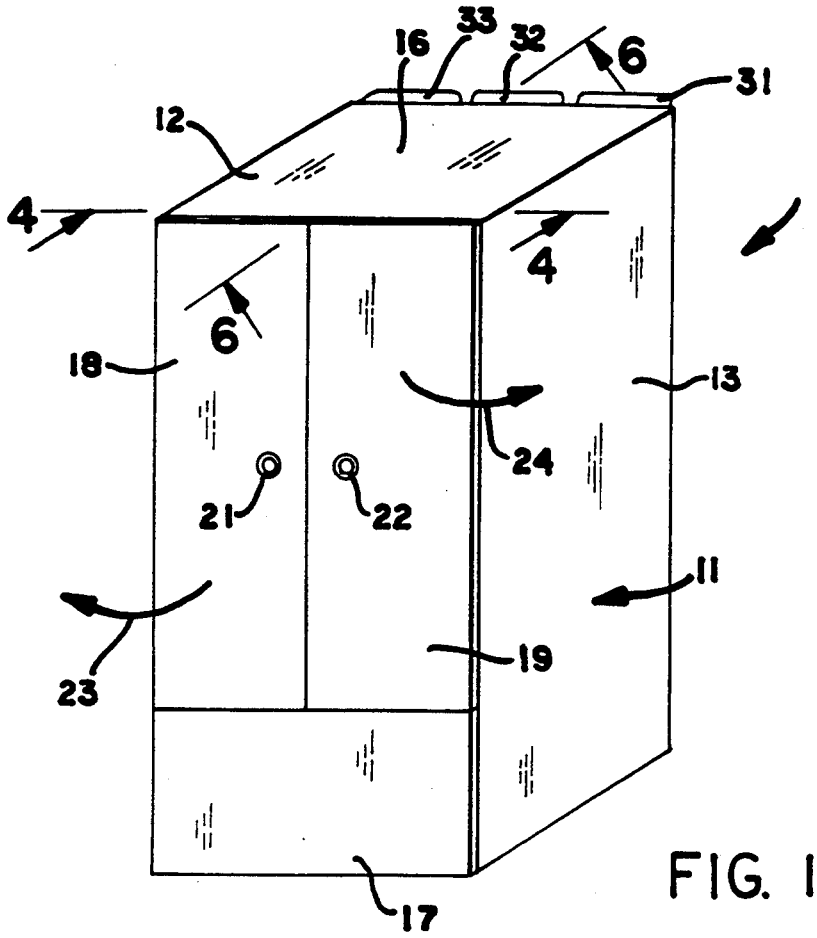
FIG. 1 is a perspective view of the dryer of the invention.
Figure 2:
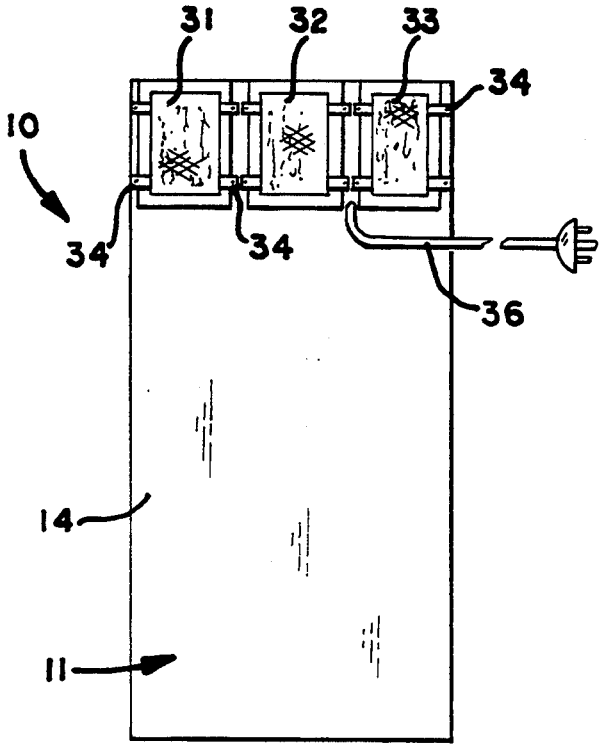
FIG. 2 is a rear elevational view thereof.

Referring to FIGS. 1 and 2, there is shown the armoire or dryer of the invention indicated generally at 10. Dryer 10 is a self-contained structure useable to dry articles and objects including, but not limited to, athletic equipment; such as hockey and baseball equipment, shoes, skates, in-line roller blade-type skates, hand and footwear, boots, socks, recreational and sports clothing and outdoor wear, sweaters, stockings and shirts that at times accumulate body perspiration or fluids, and become damp and wet in inclement weather or wet during laundry cleaning. The term "articles", as used herein, includes, but is not limited to, clothing, athletic equipment and outdoor wear and includes other products and objects that can be dried.

Figure 3:
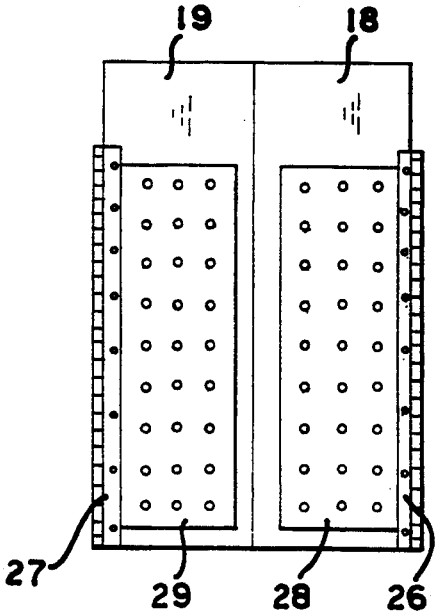
FIG. 3 is an elevational view of the inside of the doors of the dryer of FIG. 1.

Dryer 10 has a generally rectangular cabinet or housing 11, including upright side walls 12 and 13, joined to an upright back wall 14. A horizontal top wall 16 closes the top of the housing. The front of the housing has a lower front panel 17 located below a pair of doors 18 and 19. As seen in FIG. 3, hinges 26 and 27 pivotally mount doors 18 and 19 on side walls 12 and 13 so that the doors can be swung to open positions, as indicated by arrows 23 and 24 to provide full access to the interior of housing 11. Handles or knobs 21 and 22, attached to doors 18 and 19 respectively, are used as convenient hand grips to allow doors 18 and 19 to be opened and closed.

As seen in FIG. 3, peg boards 28 and 29 are secured to the inside surfaces of doors 18 and 19. Boards 28 and 29 can facilitate hooks and wire basket members for accommodating articles such as items of clothing and other objects to be dried. Other structures, such as walls with grooves, can be used to support articles within the drying chamber 41 of housing 11. For example, shelves can be used for flat drying of sweaters, shirts and other garments.

Referring to FIG. 2, the upper part of back wall 14 carries three filters 31, 32 and 33. The air filters are fiber and activated charcoal air filters that can be replaced. The charcoal air filters function to remove odors and particulates from air flowing into and out of the dryer. Other types of filters can be used to clean the air and remove odors from the air flowing into and out of the dryer. A plurality of clips or holders 34 attach filters 31, 32 and 33 to back wall 14. An electrical cord 36 extends through back wall 14 below filters 32 and 33. Cord 36 is connected to a ground fault circuit breaker 100, shown in FIG. 8.

Figure 4:
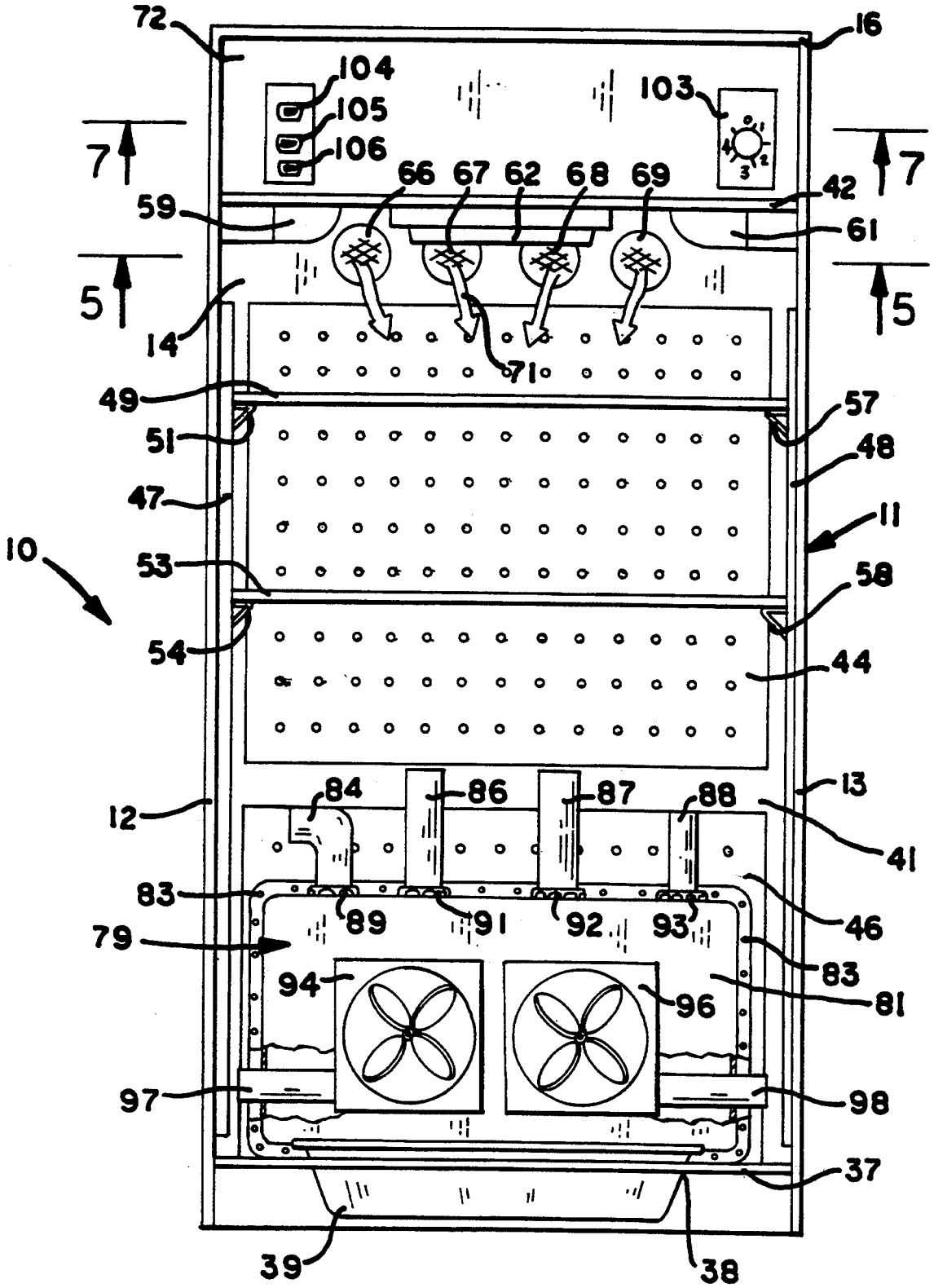
FIG. 4 is an enlarged front elevational view of the dryer taken along the line 4—4 of FIG. 1.
Figure 5:
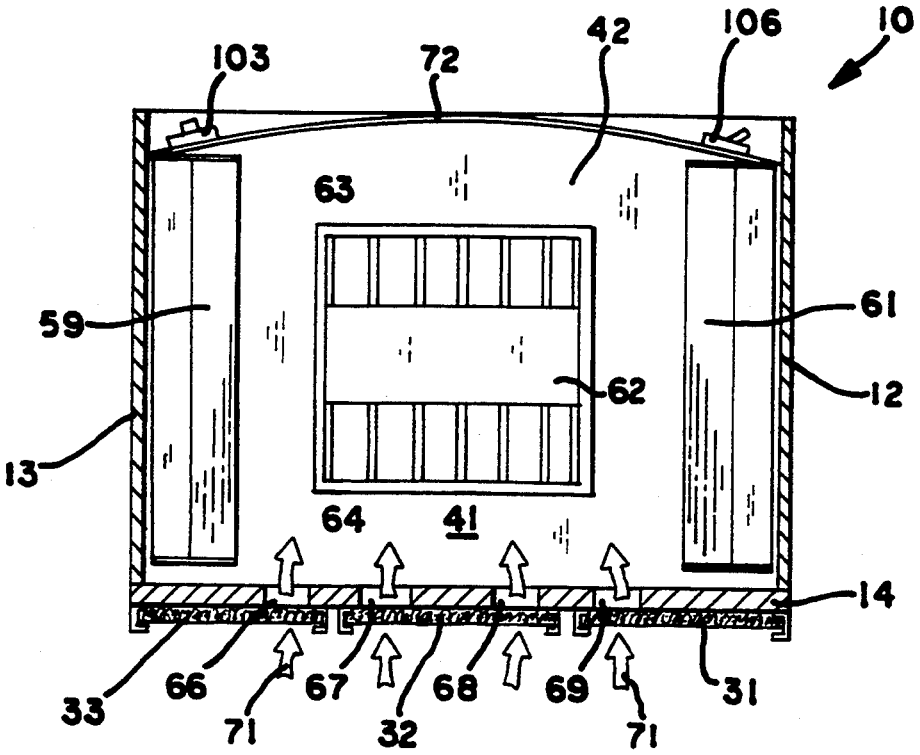
FIG. 5 is a sectional view taken along the line 5—5 of FIG. 4.
Figure 6:
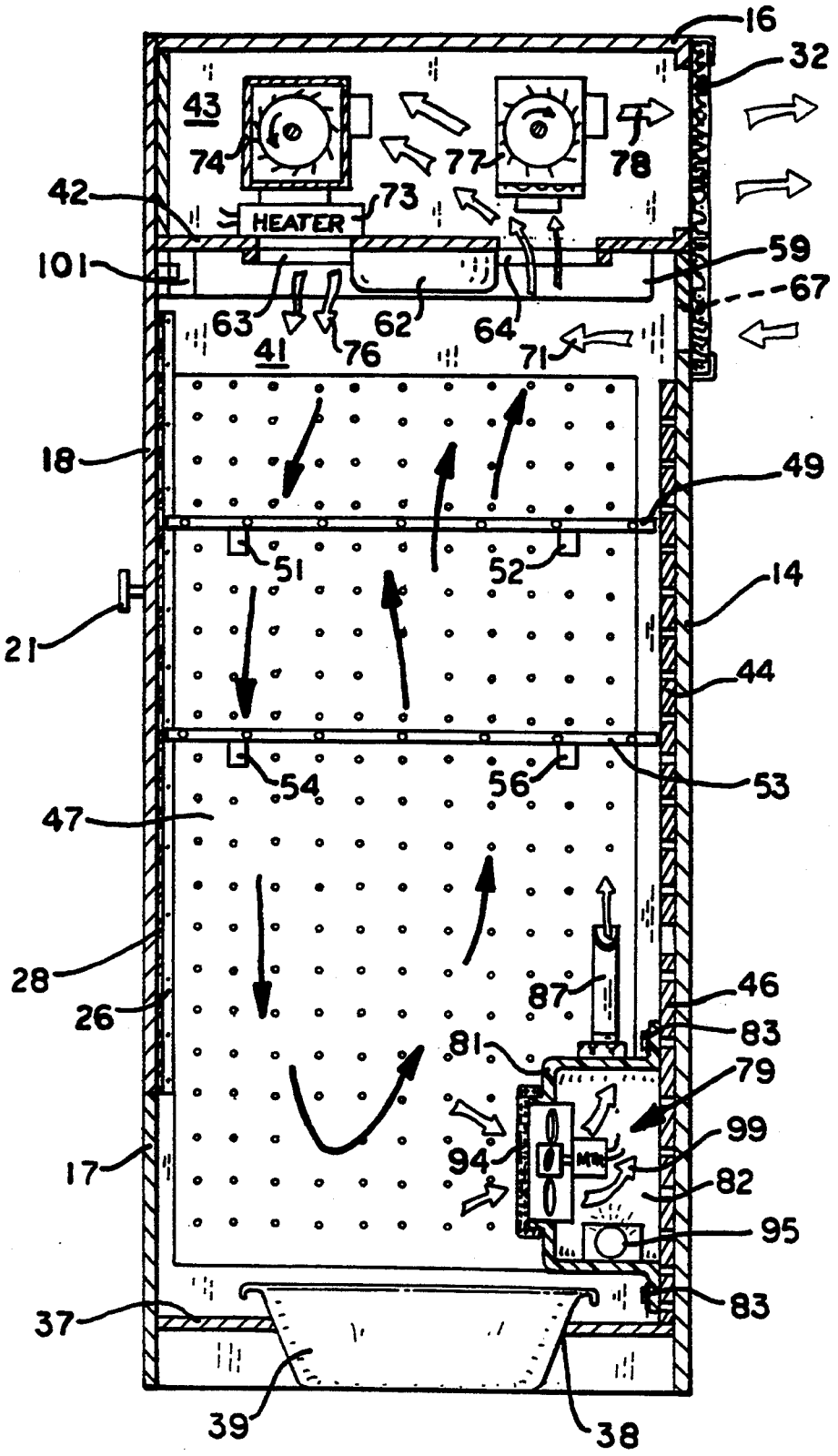
FIG. 6 is an enlarged sectional view taken along the line 6—6 of FIG. 4.

As seen in FIG. 4, a bottom wall or floor 37 is attached to lower portions of side walls 18 and 19 and back wall 14. Bottom wall 37 has a large central opening 38 accommodating a drip pan 39. Drip pan 39 has an open top to accommodate any water, ice or snow that is derived from the articles to be dried within housing 11. The articles are located within a drying chamber, indicated generally at 41, located above drip pan 39. The upper part of housing 11 has a ceiling or transverse wall 42 located below an air mixing chamber 43, as seen in FIG. 6.

The inside of back wall 14 accommodates a generally rectangular peg board 44 and a lower peg board 46. Boards 44 and 46 can be a single peg board. Peg boards 47 and 48 are secured to the insides of side walls 18 and 19. Generally horizontal shelves 49 and 53, located within chamber 41, are supported on clips 51, 52, 54 and 56 at selected heights. FIG. 6 shows additional clips 52 and 56 that support shelves 49 and 53 on peg board 47. Additional support structures or clips can be used to support shelves, hooks and other structures for supporting the articles within chamber 41.

A pair of germicidal ultraviolet light fixtures 59 and 61 are located in the upper corners of drying chamber 41. Fixtures 59 and 61 are attached to opposite sides of the lower side of transverse wall 42. The ultraviolet light emitted from fixtures 59 and 61 functions to sterilize or decontaminate the air within chamber 41 and limit mold, fungus, virus, mildew, dry rot and bacterial growth on the articles to be dried.

The center of transverse wall 42 supports a light 62 and air grills 63 and 64, allowing air to circulate between drying chamber 41 and mixing chamber 43. Back wall 14, as seen in FIG. 4, has a plurality of holes or openings 66, 67, 68 and 69 open to filters 31, 32 and 33 to allow outside air to flow into the upper portion of drying chamber 41. A single opening in back wall 14 can be used in lieu of openings 66–69. A motor-driven fan (not shown) can be mounted on back wall 14 to force additional outside air into drying chamber 41. Arrows 71 indicate the flow of air into chamber 41. Openings 66–69 allow outside air to flow into drying chamber 41 so that the dryer breathes when used for storage.

A front panel 72 closes the front portion of mixing chamber 43. Panel 72 supports a timer 103 and switches 104, 105 and 106 for controlling heater 73, ultraviolet lamps 59, 61 and 95 and the circulation of air in drying chamber 41 and air mixing chamber 43. A coin-operated mechanism (not shown) can be used to operate timer 103.

Figure 7:
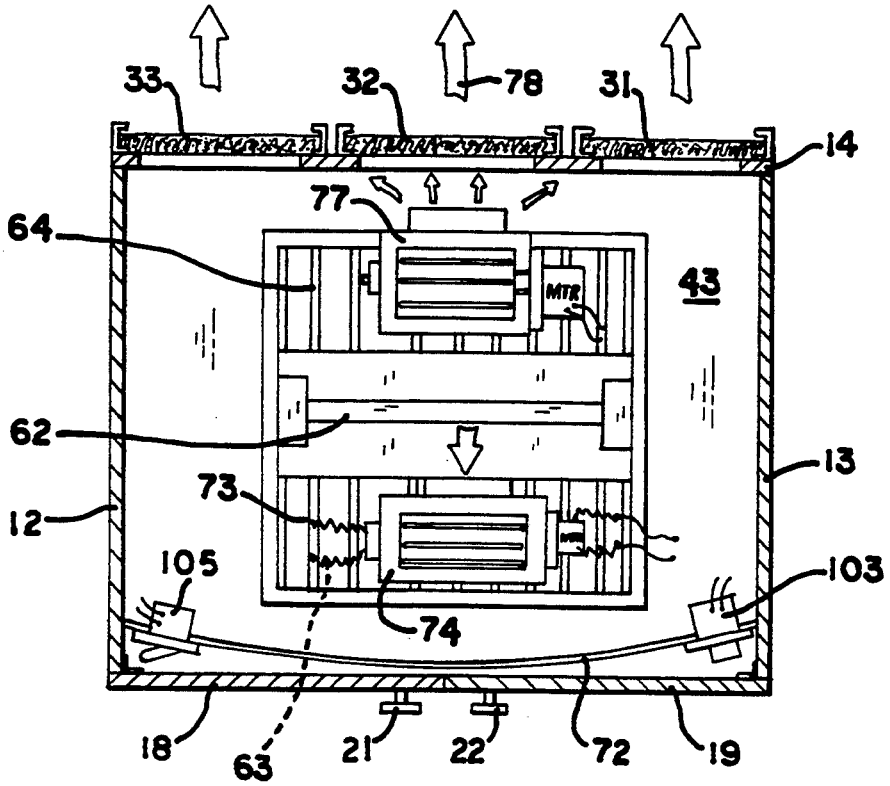
FIG. 7 is a sectional view taken along the line 7—7 of FIG. 4.

As seen in FIG. 6, a first fan or blower 74, having a squirrel-cage impeller driven with an electric motor, operates to deliver air through heater 73 and into drying chamber 41, as indicated by arrows 76. Heater 73 is shown as an electric resistance coil located between fan 74 and air grill 63. Other types of heaters including infrared light and electronic heaters can be used to heat air directed into drying chamber 41. Fan 74 and heater 73 can be a single device mounted on interior wall 42. A second exhaust fan 77, having a squirrel-cage impeller driven with an electric motor, operates to draw air from drying chamber 41 and discharge the air toward charcoal air filters 31, 32 and 33 for discharge into the atmosphere, as indicated by arrows 78. A single electric motor can be used to drive fans 74 and 77. As shown in FIG. 7, outside air is drawn through the lower portions of air filters 31, 32 and 33 to make up for the air that is discharged through air filter 32 by the operation of fan 77. Separate activated carbon filters can be used to cover holes 66–69. Fan 77 draws air from drying chamber 41 through air grill 64 and draws fresh, external air through air filters 31, 32 and 33 and holes 66–69. This air is mixed with air from drying chamber 41 in mixing chamber 43 and is discharged through heater 73 and air grill 63 into the top of drying chamber 41. The hot air from drying chamber 41 heats up the cool, fresh air thereby reducing the amount of heat energy required by heater 73 to heat the air being forced into drying chamber 41 by fan 74.

Figure 13:
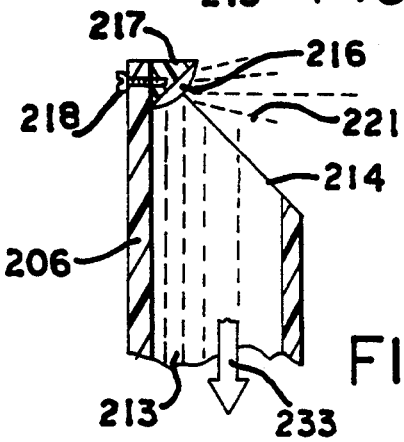
FIG. 13 is an enlarged sectional view taken along the line 12—12 of FIG. 10.

As seen in FIGS. 4 and 6, a second drying unit termed a boot dryer, indicated generally at 79, is located in the lower portion of drying chamber 41 adjacent back wall 14. Boot dryer 79 has a housing or casing 81 that is attached with fasteners 83, such as bolts, to back wall 14. Boot dryer 79 can be positioned at a selected elevation relative to back wall 14, as desired by the user of the dryer. Casing 81 has an internal chamber 82 that is open to a plurality of upright tubes 84, 86, 87 and 88. Sleeves with tightening nuts 89, 91, 92 and 93, secured to the top wall of casing 81, accommodate lower ends of tubes 84, 86, 87 and 88 so that the tubes can be removed and replaced with tubes having shapes that accommodate different types of mittens, gloves, boots, shoes, skates and the like. The sleeves associated with nuts 89, 91, 92 and 93 allow for vertical adjustment and circumferential positioning of tubes 84, 86, 87 and 88 to accommodate different types and sizes of articles. FIG. 4 shows tubes having different shapes and elevations that can be selectively attached to casing 81. An ultraviolet lamp 95 within casing 81 emits light to the casing and through tubes 84 and 86–88 to destroy contaminants in the air and articles located on the tines. Mirrors, as shown in FIG. 13, reflect the UV light into the articles on the tubes. The front wall of casing 81 accommodates a pair of third and fourth fans or blowers 94 and 96 having blades rotated with electric motors to draw air from drying chamber 41 into boot dryer chamber 82 which is then forced through tubes 84, 86, 87 and 88 into the boots or like objects that are mounted on the tubes. Fans 94 and 96 also operate to discharge air laterally through tubes 97 and 98 into the lower portions of drying chamber 41, as indicated by arrows 99 in FIG. 6, to increase air circulation within the lower portion of drying chamber 41. A single fan can be used in lieu of fans 94 and 96. The direction of rotation of the fan blades associated with fans 94 and 96 can be reversed so that the air is drawn into tubes 84, 86, 87 and 88 and discharged into drying chamber 41.

Figure 8:
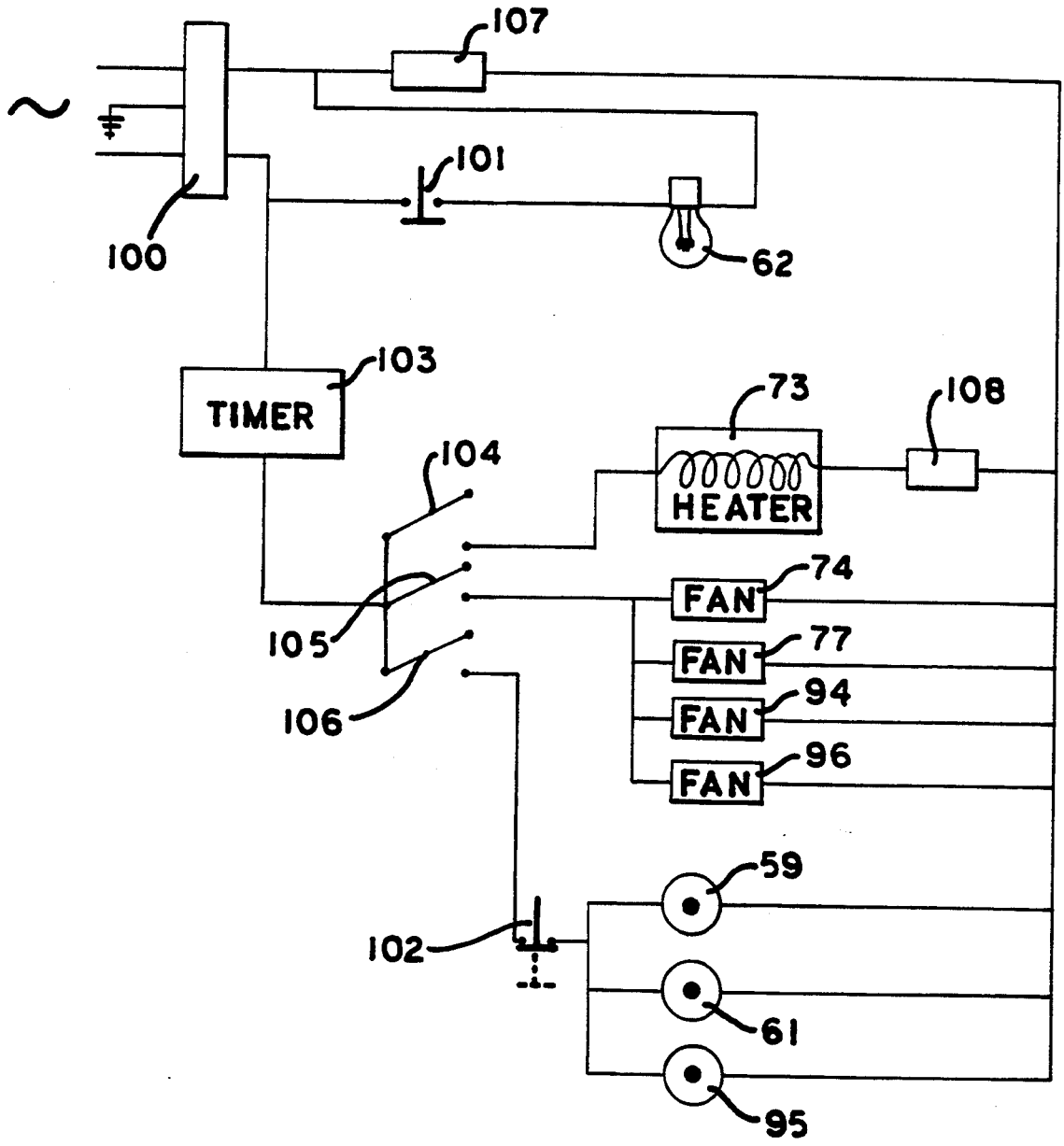
FIG. 8 is an electrical circuit diagram for the heater, fans and lights of the dryer of FIG. 1.

Referring to FIG. 8, there is shown the electrical circuit diagram for heater 73, fans 74, 77, 94 and 96 and lights 59, 61 and 62 of dryer 10. A door-operated switch 101 functions to connect light 62 with the power source connected to ground fault circuit breaker 100 when door 18 is open. Switch 101 is normally closed when door 18 is open so that light 62 is ON when the articles are placed in drying chamber 41. When door 18 is closed, switch 101 is open, thereby turning light 62 OFF. Timer 103 is directly connected to three switches 104, 105 and 106. Switch 104 is operable to connect the power to heater 73. Switch 105 is operable to connect the power to all of the fans 74, 77, 94 and 96 so that the fans simultaneously operate to circulate and recirculate the air in the drying chamber and concurrently mix the air from the drying chamber with outside air in mixing chamber 43. Fans 94 and 96 also operate to move the air through the boot dryer as they draw air from the lower portion of the drying chamber.

Switch 106 is electrically connected to ultraviolet lights 59 and 61. A door-operated switch 102 is interposed in the line between switch 106 and lights 59 and 61. Switch 102 is normally closed when door 18 is closed. When door 18 is open, the switch is opened so that ultraviolet lights 59, 61 and 95 are OFF when door 18 is open.

The electrical circuit includes an adjustable humidistat 107 that senses the humidity of the air in drying chamber 41. When the humidity in the drying chamber 41 is below a selected limit, humidistat 107 will automatically open and thereby terminate the power to the timer and shut the entire system OFF. The electrical circuit also includes an adjustable thermostat 108 which is normally closed. When the temperature of the air within drying chamber 41 exceeds a pre-determined limit, thermostat 108 will open and thereby terminate the power to heater 73. The fans and ultraviolet lights remain ON. When the temperature in drying chamber 41 drops below a selected point, heater 73 is turned ON. Thermostat 108 is adjustable to change the upper and lower limits of the air temperature within drying chamber 41.

In use, doors 18 and 19 are moved to open positions to provide access to drying chamber 41. The articles, such as clothing, shoes and the like are placed within drying chamber 41 on suitable trays or hangers. The boots, shoes, skates and socks are placed over tubes 84, 86, 87 and 88 so that they can receive the air flowing through the tubes. Ultraviolet lights 59, 61 and 95 are OFF, as door-operated switch 102 is open or timer 103 is OFF. Light 62 is ON as door-operated switch 101 is closed when door 18 is open. Switches 104, 105 and 106 are turned to the ON position. Timer 103 is then set to a selected time, such as 30 minutes, to provide a definite drying duration. When switch 104 is closed, heater 73 operates to heat the air flowing through the heater. Switch 105, when closed, operates all of fans 74, 77, 94 and 96. Fan 74 drives the air from mixing chamber 43 through heater 73 and to the upper portion of drying chamber 41. Fan 77 draws air from drying chamber 41 and discharges the air through filters 31, 32 and 33 into the atmosphere. Part of the air drawn through air grill 64 flows into fan 74 and is recirculated in drying chamber 41. Outside air is also drawn through filters 31, 32 and 33, as seen in FIG. 7, and mixed with the air from drying chamber 41. This air is moved by fan 77 through heater 77 into drying chamber 41. Fans 94 and 96 operate to move air from the lower portion of the drying chambers through the boot dryer into tubes 84–88 that accommodate the shoes, skates, boots and the like that are mounted thereon. The air flowing through the boots, skates, shoes and the like pick up moisture from the insides of these goods to facilitate the internal drying thereof. The UV light from ultraviolet lamp 95 destroys contaminants in the air and articles mounted on tubes 84–88. Fans 94 and 96 also recirculate air to the lower portion of drying chamber 41 through lateral tubes 97 and 98, as seen in FIG. 4. When switch 106 is closed, ultraviolet lights 59, 61 and 95 are ON. Subjecting the air and articles within the chamber and retained on tubes 84, 86, 87 and 88 to ultraviolet light has a decontamination effect thereon. When the humidity of the air in the drying chamber drops below a selected value, humidistat 107 will turn the system OFF. Thermostat 108 will turn heater 73 OFF when the temperature of the air exceeds a pre-determined value and turns heater 73 ON when the air temperature drops below a set point. Thus, the dryer will not over-dry the articles located in drying chamber 41 nor will the temperature of the air within the drying chamber exceed a selected value, as determined by the thermostat.

Referring to FIGS. 9–13, there is shown a modification of the boot dryer, indicated generally at 200, useable with dryer 11 or independently of the dryer. Boot dryer 200 can replace boot dryer 79 located within drying chamber 41. Dryer 200 is used to remove moisture and odors from shoes, skates, boots, in-line roller blade-type skates, socks, gloves, mittens and other hand and footwear.

Figure 11:
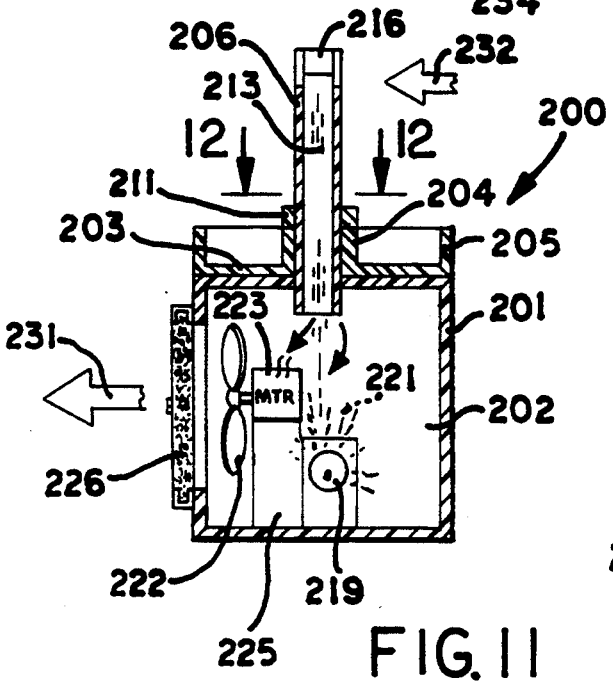
FIG. 11 is a sectional view taken along the line 11—11 of FIG. 10.
Figure 12:
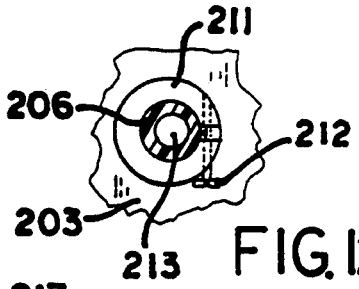
FIG. 12 is an enlarged sectional view taken along the line 12—12 of FIG. 11.

Dryer 200 has a generally rectangular casing 201 enclosing an internal chamber 202. A drip pan or tray 203 is located on top of casing 201 to collect any water, snow, ice, mud or the like that may fall from the articles being dried. Tray 201 is generally pan-shaped with four laterally located upright bosses 204 and a peripheral outer upright side wall 205. Upright tubes 206, 207, 208 and 209 extend through tubular bosses 204 down into chamber 202. As seen in FIG. 12, split clamp collar 211, located about tube 206, is retained thereon with bolt 212. The collar allows tube 206 to be vertically adjusted. Tube 206 can also be circumferentially located to accommodate different types and styles of articles to be placed thereon. Other types of holding structures can be used to retain tube 206 on casing 201. Tube 206 has an upright continuous passage 213 to allow air to flow through tube 206 into chamber 202. The upper end of tube 206 has a biased or angled end 214, as shown in FIG. 13, and accommodates a convex mirror 216 or fisheye mirror. Block 217, attached to tube 206 with bolt 218, supports mirror 216 at a angle of about 45 degrees with respect to the longitudinal axis of passage 213. Other structures, such as a wire cage, can be used to support mirror 216 in alignment with tube 206. The cage also functions to hold boots, shoes, socks and mittens open during drying. As seen in FIG. 11, an ultraviolet lamp 219, located within chamber 202, is axially aligned with passage 213. Lamp 219 emits ultraviolet light 221 into chamber 202. A portion of the ultraviolet light is reflected laterally by mirror 216, as shown in broken lines in FIG. 13 into the interior of the article mounted on tube 206. Thus, the ultraviolet light is directed to the toe and heel sections of the boot, socks or the like that are placed on tube 206. The ultraviolet light has a germicidal and disinfectant effect on contaminants including bacteria, spores, fungus, viruses and the like that may be present in the article located on tube 206 and the air flowing therethrough. Tubes 207, 208 and 209 have the same structure as tube 206 and mirror 216. Dryer 200 can have one or more tubes having shapes to accommodate the articles to be mounted thereon.

Figure 9:
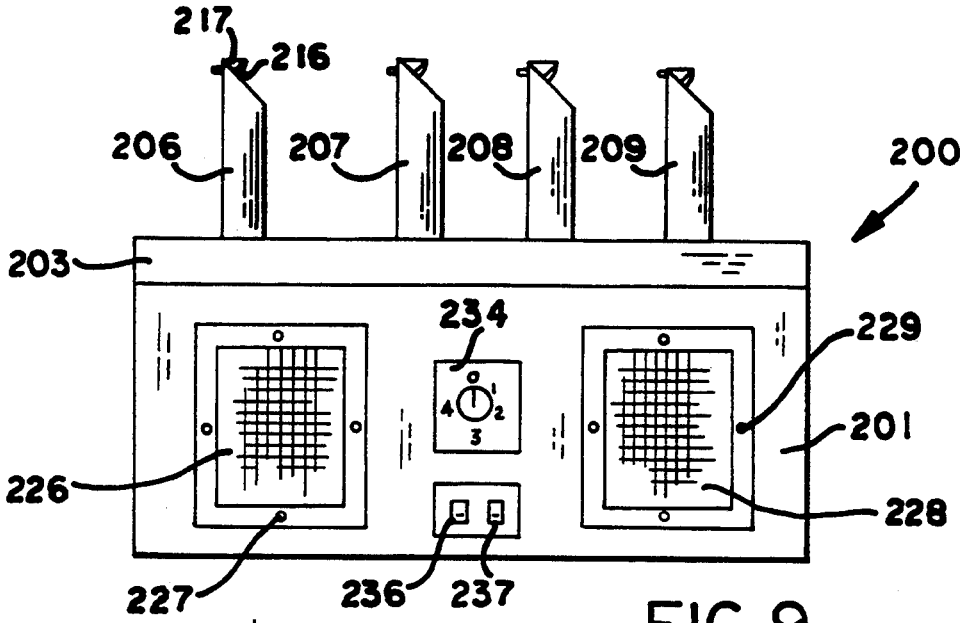
FIG. 9 is a front elevational view of a modification of the boot dryer.
Figure 10:
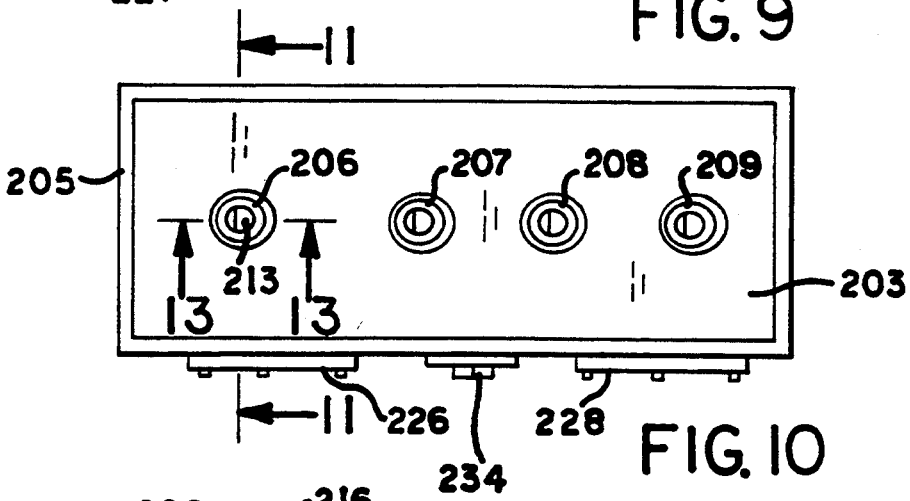
FIG. 10 is a top plan view of FIG. 9.

Air is drawn into chamber 202 with fan 222, operated with electric motor 223. Support or stand 224 locates fan 222 in alignment with an opening in casing 201 covered with filter 226, such as an activated charcoal filter. A plurality of fasteners 227, as seen in FIG. 9, secures filter 226 to casing 201. A second filter, such as an activated carbon filter 228, is located on casing 201 and attached thereto with fasteners 229. Filter 228 covers an opening in casing 201 open to chamber 202. A second fan driven by a motor (not shown) is located behind filter 228 to move air from chamber 202 through filter 228. An example of this fan and motor is fan 222 and motor 223, as shown in FIG. 11. Other types of structures, such as blowers, impellers and the like, driven by motors, can be used to move air from chamber 202 through filters 226 and 228.

Returning to FIG. 9, timer 234 is mounted on the center portion of casing 201 between filters 226 and 228. Timer 234 is used to set the interval of time on the operation of the fans 222 that move the air from chamber 202 and filters 226 and 228. The incoming air is indicated by arrows 232 and 233 moves into the articles, such as a boot, shoe or the like to be dried and through tube passage 213 into chamber 202. The external air indicated by arrow 232 can be heated with a heating coil (not shown) located within a hood (not shown) surrounding tubes 206–209 and articles mounted thereon. Other types of heating structures can be used to heat the air used to dry articles mounted on the tubes. A heater can be located within chamber 202 when fan 222 moves air out of tubes 206–209 and articles mounted thereon. This air picks up the moisture, as well as the odors from the article that is being dried. The air moving through filters 226 and 228, which contain activated charcoal or like materials that retain or dissipate the odors, removes the odors from the air which is discharged into the outside of the dryer as indicated by arrow 231 in FIG. 11. The motors 223 for the fans are connected to an electrical power source via switches 236 and 237. Switches 236 and 237 can be simultaneously turned ON or individually turned ON to control the flow of air through tubes 206–209 into chamber 202 and through filters 226 and 228.

When dryer 200 is used with dryer 11, motors 223 for fans 222, can be directly connected to switch 105 so that the exhaust and recirculating fans 74 and 77 operate concurrently with boot dryer motors 223.

Figure 14:
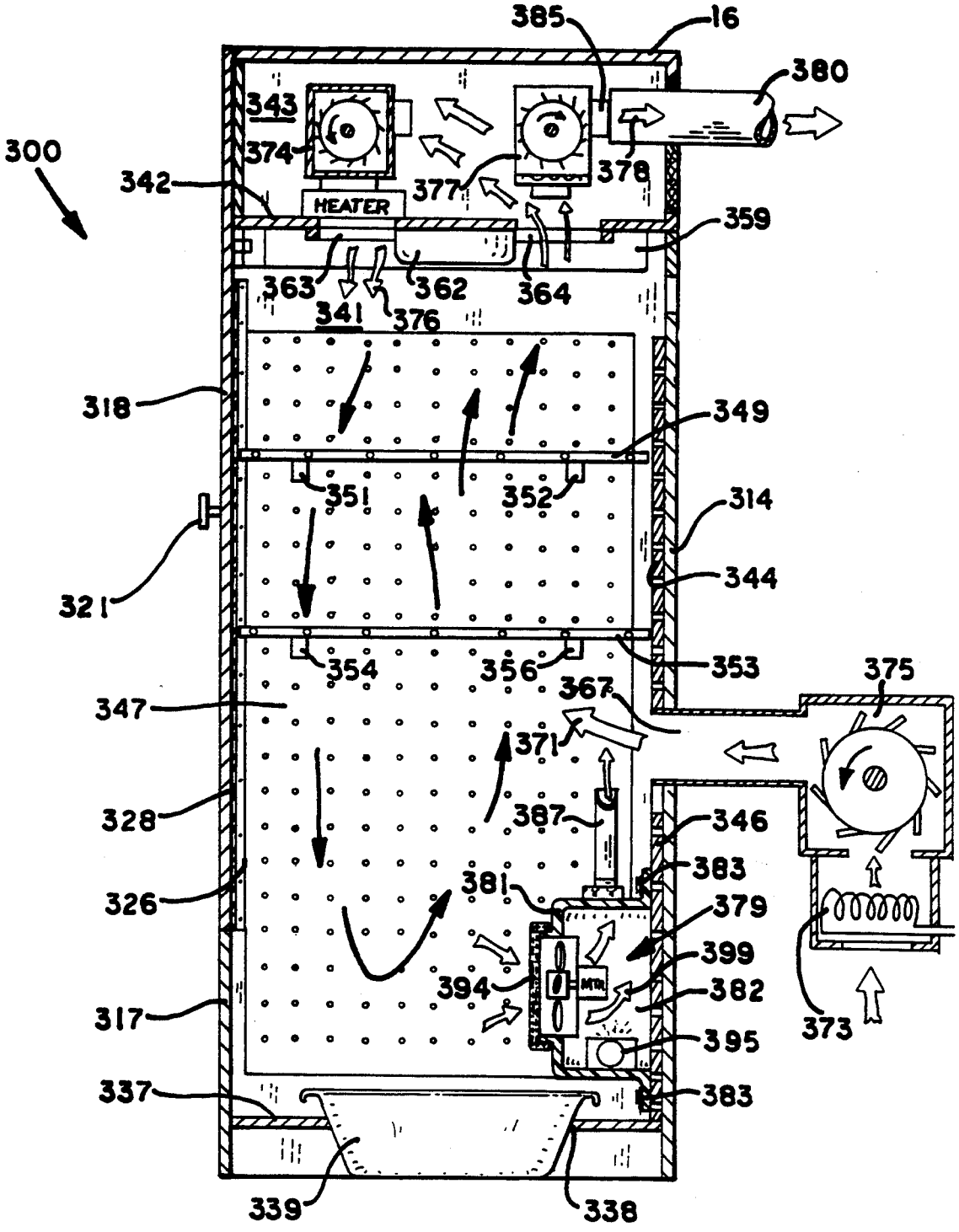
FIG. 14 is a sectional view similar to FIG. 6, showing a modification of the dryer of FIGS. 1-8.
Figure 15:
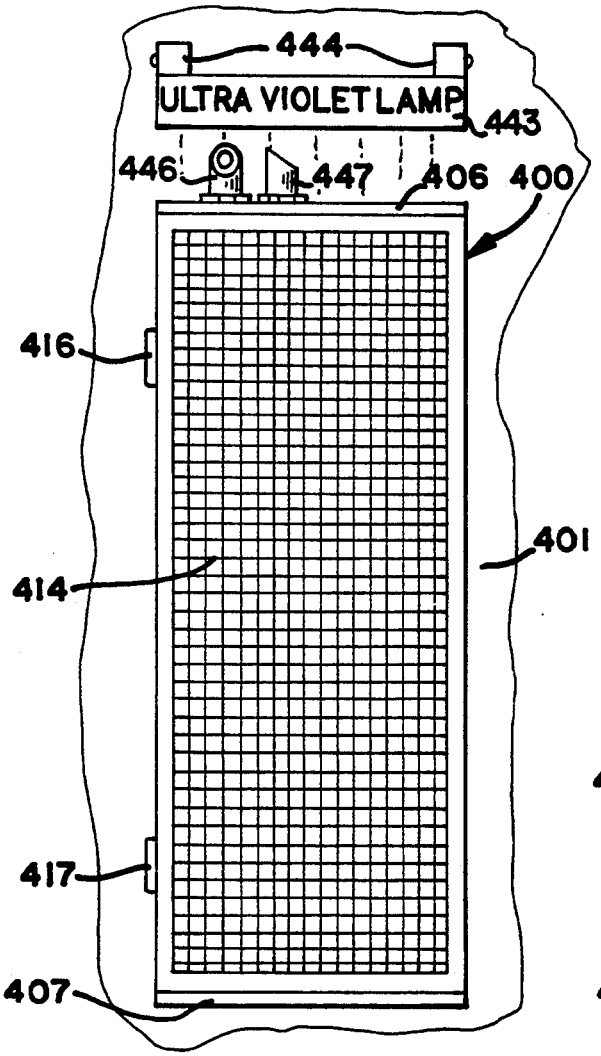
FIG. 15 is a front elevational view of a modification of the dryer of the invention located in a room, such as a locker room, to dry equipment and air in the locker room and reduce odors therein.

Referring to FIG. 14, there is shown a dryer of the invention, indicated generally at 300, used with the central heating system of a building to dry articles of clothing, sporting equipment, athletic equipment and the like. Dryer 300 can be used with additional identical dryers in a locker room environment to dry the sports and recreational equipment used by persons, players, coaches, referees and the like. Dryer 300 has the same structure as the dryer shown in FIGS. 1–8. The common structure has the same reference numbers with the prefix "3". The heat source is the structure's heater or furnace, illustrated as heater 373 that accommodates incoming air. Other sources of heat can be used to supply hot air to dryer 300 or a group of dryers. The air is drawn through heater 273 with a fan, blower or impeller 375 that is driven with an electric motor (not shown). The air moved by blower 375 moves into the drying chamber 341, as indicated by arrow 371. Impeller 375 can be used to supply air through suitable ducts to additional dryers. Exhaust fan 377 delivers air through duct 380 which can lead to an exhaust fan or external atmosphere. Duct system 380 can be returned back to heater 373, as is commonly used in a forced-air furnace system of a home. The hot air, indicated by arrow 371, moves through drying chamber 341 and moves up into mixing chamber 342. Recirculating fan 374 delivers air from mixing chamber 343 back into drying chamber 341. The air is recirculated in the drying chamber to accumulate additional moisture, thereby providing effective heat energy and drying conditions. Part of the air from drying chamber 342 is moved with exhaust fan 377 to exhaust duct 380, as shown by arrow 378. Duct 380 is connected to a short tube having a back flow damper 385 to prevent flow of air from duct 380 back into fan 377. Duct 380 can be part of the return air system of a hot forced-air furnace or connected to tubing to direct exhaust air to the outside environment. Duct 380 can be connected to conduits having filters, such as carbon filters, to direct air back into the room accommodating dryer 300.

Referring to FIGS. 15–19, there is shown a modification of the dryer of the invention, indicated generally at 400, located in an enclosed room, such as a locker room including, but not limited to, recreational and athletic locker rooms and industrial locker rooms. The dryer operates to remove moisture and odors from the air in the locker room thereby drying equipment fixtures and structures in the locker room.

Figure 17:
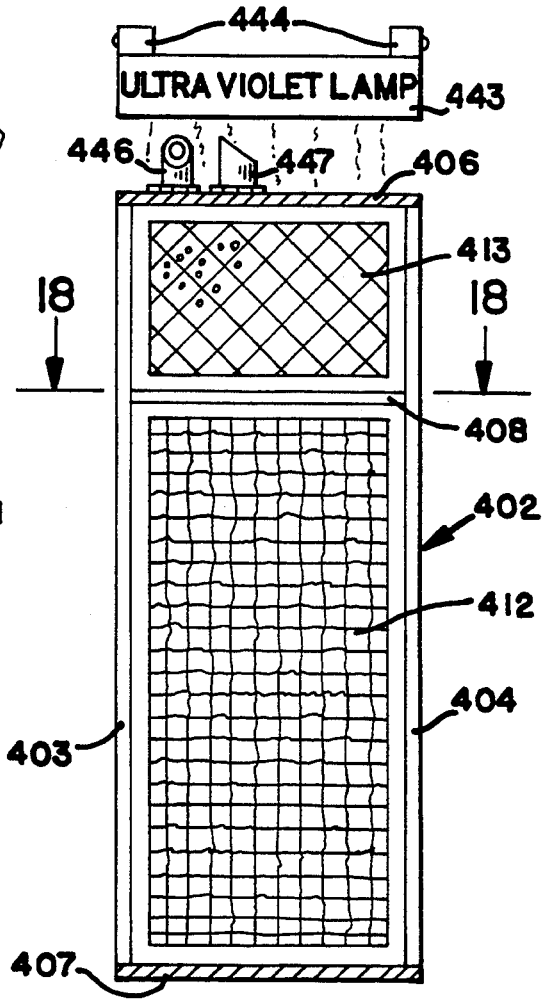
FIG. 17 is a sectional view taken along the line 17—17 of FIG. 16.

Dryer 400 has a generally rectangular housing, indicated generally at 402. Housing 402 has upright side walls 403 and 404 joined to upright back wall 405. The top of the housing is closed with top wall 406. Bottom wall 407 is joined to lower portions of side walls 403 and 404 and back wall 405. An internal generally horizontal wall 408 is located inside the housing. Wall 408 divides the interior of the housing into a first or lower chamber 409 and a second or upper chamber 411. The front of the housing accommodates upright air filter 412. Air filter 412, such as a fabric or glass fiber filter, removes particulates from the air moving into first chamber 409. Filter 412 can be an activated carbon filter to remove odors from the air, as well as particulates. A second filter 413 is located across the outlet of the second chamber 411. Filter 413 is an activated carbon filter that removes odors from the air that is discharged into room 401, as indicated by arrows 434. As seen in FIG. 17, filter 413 is a generally rectangular carbon filter that can be removed from housing 402 and replaced with a new filter.

The front of housing 402 is closed with a generally rectangular screen door 414. Hinges 416 pivotally mount the door on side wall 403. The screen of door 414 protects filters 412 and 413 from damage and provides the dryer with an ornamental appearance.

Figure 19:
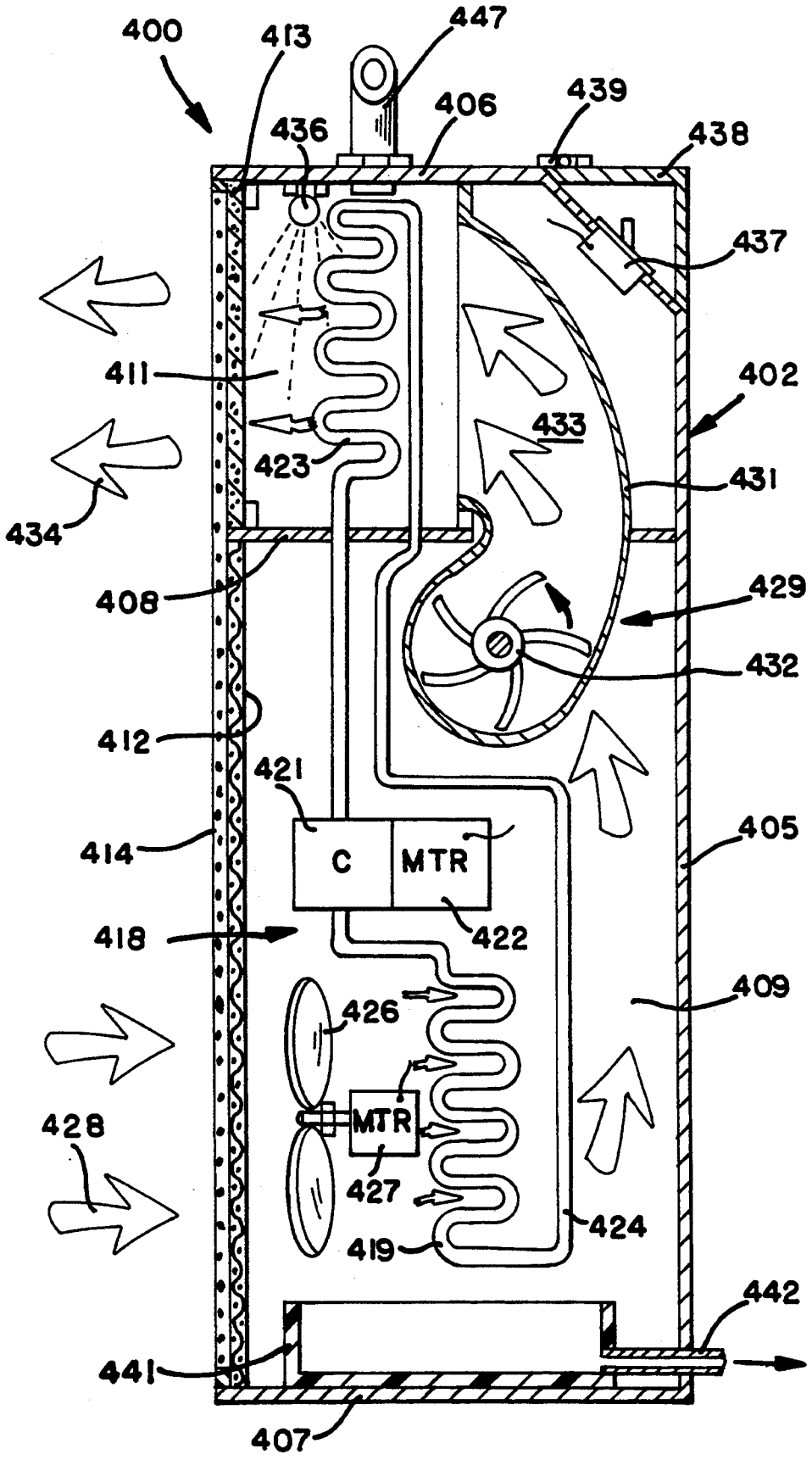
FIG. 19 is a sectional view taken along the line 19—19 of FIG. 16.

Referring to FIG. 19, a dehumidifier system, indicated generally at 418, is located within housing 402. Dehumidifier system 418 has a first or cooling coil 419, located in chamber 409. Coil 419 is coupled to compressor 421, driven by electric motor 422. The compressor and motor can be a single refrigeration-combined compressor and motor. A second heating coil 423 is located in chamber 411 rearwardly of filter 413. Line or tube 424 connects coils 419 and 423 to complete the refrigeration system of dehumidifier 418. Fan 426, driven by electric motor 427, is located adjacent first coil 419. Fan 426 operates to draw air from room 401, as indicated by arrows 428 into chamber 409. The air flows through coil 419, thereby cooling the air. The moisture, including water from coil 419, drips down into pan 441 and flows through tube 442 to a selected location, such as the water drain for room 401. An ultraviolet light fixture (not shown) can be located within chamber 409 to decontaminate the structure and air therein.

Blower 429, located within a squirrel-type housing 431, having a passage 433 open to the second chamber 411, draws air, as indicated by arrows 430 from chamber 409 and discharges the air into chamber 411. The air flows through heating coil 423 and filter 413 into the room, as indicated by arrows 434. As the air passes through coil 423, it picks up heat from coil 423 whereby heated air is discharged into room 401.

Ultraviolet lamp 436 is mounted on top wall 406 between filter 413 and coil 423. The ultraviolet light from lamp 436 neutralizes contaminants including bacteria in the air flowing through chamber 411 that may accumulate on filter 413 and coil 423.

Figure 16:
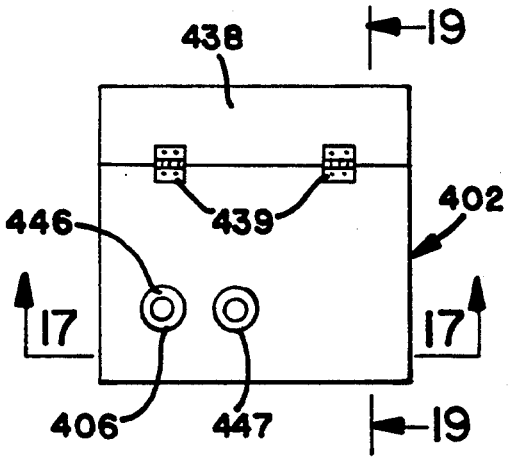
FIG. 16 is a top plan view of FIG. 15.
Figure 18:
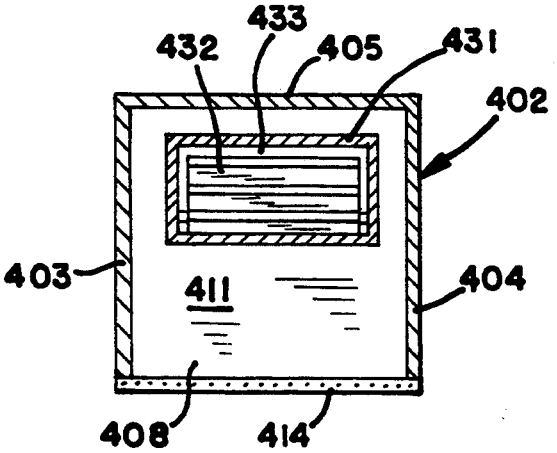
FIG. 18 is a sectional view taken along the line 18—18 of FIG. 17.

Top wall 406 of the housing supports control switch 437 and other controls, such as a timer (not shown), for operating motors 422 and 427, the motor driving impeller 432 and ultraviolet light 436. Cover 438 encloses control switches 437. Cover 438 is pivotally mounted on top wall 406 with a pair of hinges 439, as seen in FIG. 16. Top wall 406 also supports a pair of upright tubes 446 and 447 having passages open to chamber 411 and room 401. Boots, shoes, gloves, socks and like hand and foot wear can be placed over tubes 446 and 447 whereby they are subjected to flowing air to remove moisture and odors.

Ultraviolet lamp fixture 443 is mounted on the ceiling or walls of room 401. The light emitted from the ultraviolet lamp fixture controls the propagation of odor-causing bacterial growth on equipment, benches, floors, walls and in like places. The ultraviolet light will also kill bacteria in the air. The ultraviolet lamp fixture is adapted to be turned ON during the hours that room 401 is not in use. Motion sensors 444 operate to automatically shut OFF the ultraviolet light fixture if there is any movement, such as the movement of a person in room 401.

Dryer 400 operates to recirculate and regenerate the air in the locker room with a minimum of heat loss to the outside of the room. The dryer also reduces the humidity of the air and odors normally associated with locker rooms. The ultraviolet lights have a sanitizing effect on the air and equipment in the locker room.

Dryer 300, shown in FIG. 14, can be used in conjunction with dryer 400 to direct air back into the room. Air discharged by dryer 300 is directed into chamber 409 of dryer 400. The air flowing through dryer 400 removes moisture and odors from air discharged back into the room.

Figure 20:
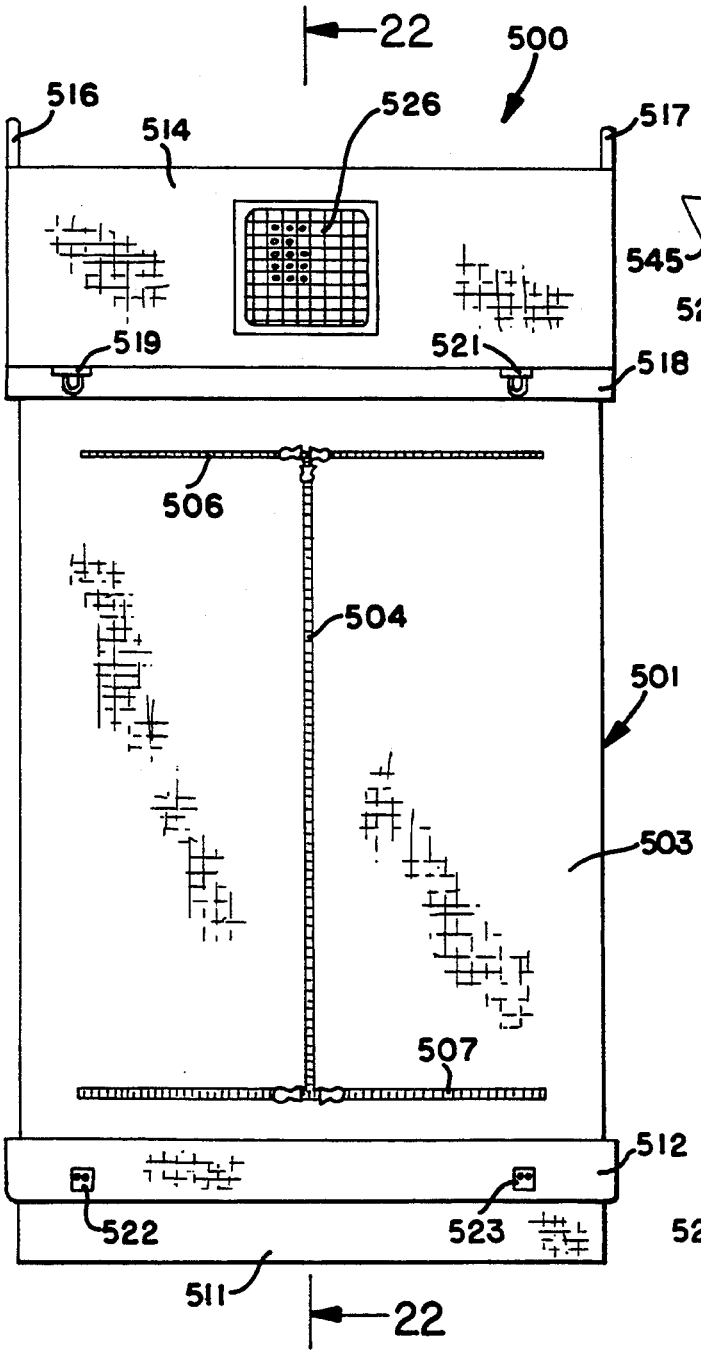
FIG. 20 is a front elevational view of a third modification of the dryer of the invention.
Figure 21:
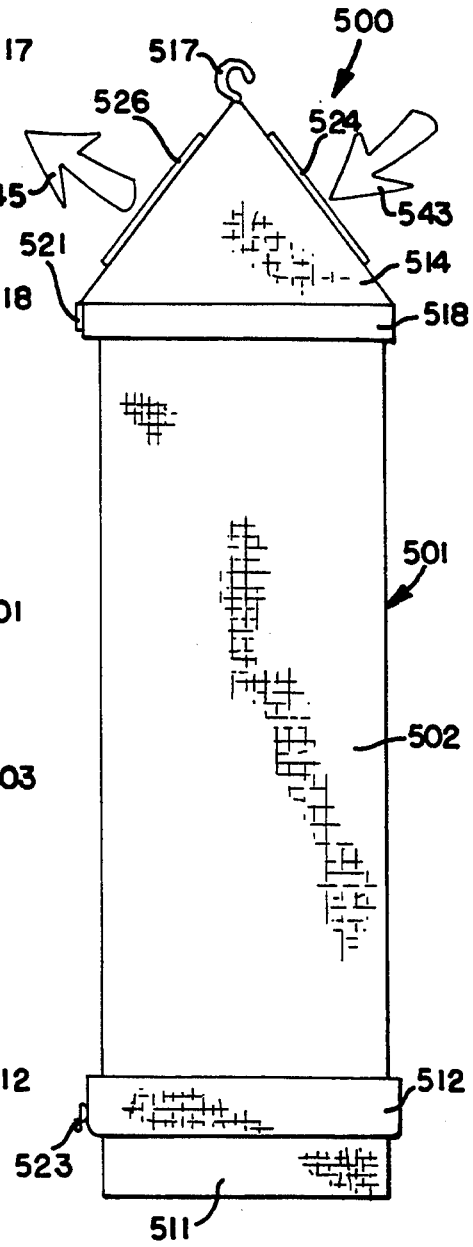
FIG. 21 is a side elevational view of FIG. 20.
Figure 22:
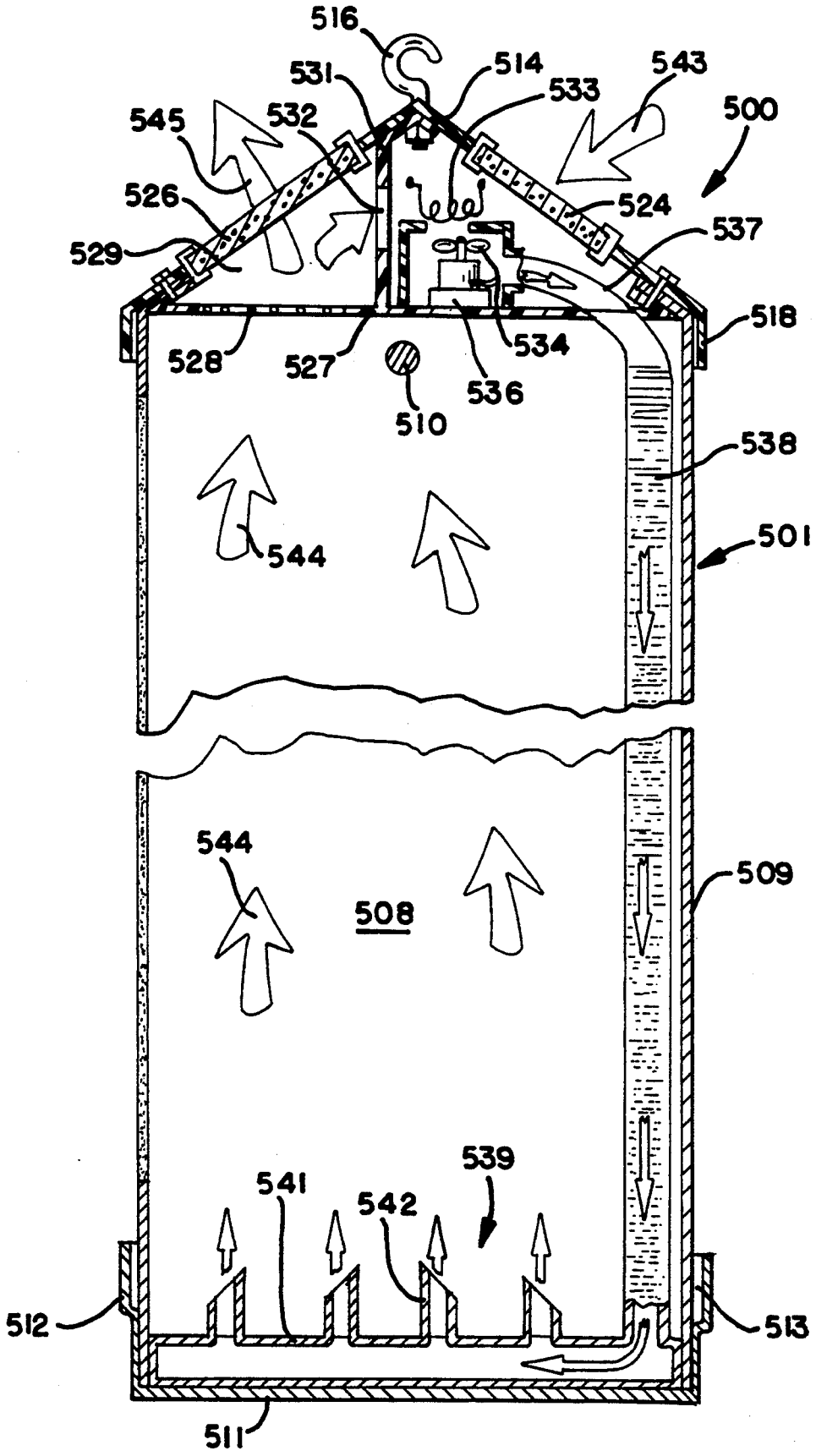
FIG. 22 is an enlarged foreshortened sectional view taken along the line 22—22 of FIG. 20.
Figure 23:
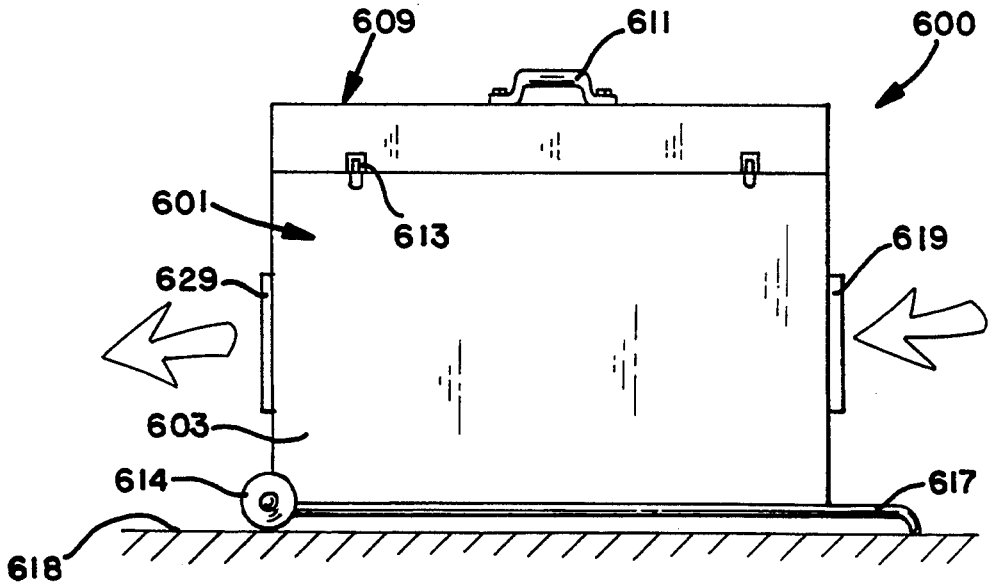
FIG. 23 is a side elevational view of a fourth modification of the dryer of the invention.

Referring to FIGS. 20–22, there is shown another modification of the dryer of the invention, indicated generally at 500. The dryer 100 is a portable and collapsible structure useable in rooms, such as hotel and motel rooms, for drying and storing articles of clothing, athletic equipment, sports gear and the like.

Dryer 500 has a housing 501 comprising upright side wall 502, front wall 503 and back wall 509. The side wall, front wall and back wall are made of flexible material, such as fabric, plastic or canvas. As seen in FIG. 20, front wall 503 has a central vertical zipper 504 and horizontal upper and lower zippers 506 and 507. Zippers 504, 506 and 507 allow the user access to interior drying chamber 508 of housing 501. The upper portion of drying chamber 508 accommodates horizontal rod or bar 510 used to hang up clothing and articles in drying chamber 508. Opposite ends of rod 510 are anchored to top member 514. The bottom of housing 501 is closed with bottom member 511. Bottom member 511 has a generally pan shape with upright peripheral flange 512 forming an upwardly open pocket or recess 513 to accommodate downwardly directed flanges or lips 518 of top member 514. Top member 514 can be moved downwardly and attached to bottom member 511 with a plurality of hooks or latches 519 and 521 that cooperate with clips 522 and 523. The side wall, back wall and front wall, being made of collapsible and flexible material, will fold down into bottom member 511.

As seen in FIGS. 20 and 21, top member 514 supports a pair of downwardly open hooks 516 and 517. Hooks 516 and 517 permit the dryer to be mounted on a horizontal rod or bar that is conventionally located in a closet. Other types of hanger structures can be used to connect top member 514 to a support.

Top member 514 supports air inlet filter 524, which allows air, as indicated by arrows 543, to flow into housing 501. The opposite side of top member 514 supports air outlet filter 526 that allows air to flow externally of dryer 500, as indicated by arrows 545. Filters 524 and 526 can contain activated charcoal or other material that remove odors from the air passing through the filters. The lower portion of top member 514 supports a horizontal interior wall 527 having an air opening 528 that allows air to flow from drying chamber 508 into air mixing chamber 529. Air outlet filter 526 is in communication with air mixing chamber 529. A generally central vertical wall 531 is located in air mixing chamber 529. Wall 531 has opening 532 that directs air to heater 533. Heater 533 can be an electrical coil heater, infrared light or other type of device that heats air. Fan 534, driven with electric motor 536, is located adjacent heater 533 to move air through heater 533 and into tube 537 leading to a flexible elongated duct 538. As seen in FIG. 22, duct 538 extends downwardly adjacent back wall 509 to a boot dryer, indicated generally at 539. Duct 538 can be used to discharge air into drying chamber 508. Boot dryer 539 is located within bottom member 511 and accommodates boots, mittens, shoes, socks and like hand and foot wear. Boot dryer 539 has an elongated manifold 541 supporting a plurality of upright tubes 542. Controls (not shown), including switches and a timer, are used to connect the fan motor to electric power.

In use, outside air, indicated by arrows 543, is drawn through filter 524 by the operation of fan 534. Fan 534 moves air from mixing chamber 529 into discharge tube 537 connected to duct 538. Air flows downwardly through duct 538 into manifold 541 of boot dryer 539. Tubes 542 direct the air upwardly into drying chamber 508. The air flows through drying chamber 508, as indicated by arrows 544, and into mixing chamber 529 where part of the air is discharged through the filter to the atmosphere. Another part of the air is drawn through inlet opening 532 adjacent heater 533 and recirculated in the drying chamber. The articles supported on rod 510 are dried by the air moving through drying chamber 508.

Referring to FIGS. 23–26, there is shown a fourth modification of the dryer of the invention, indicated generally at 600. Dryer 600 is a movable and portable structure useable to dry and store articles, such as clothing, athletic equipment and recreational products.

Figure 26:
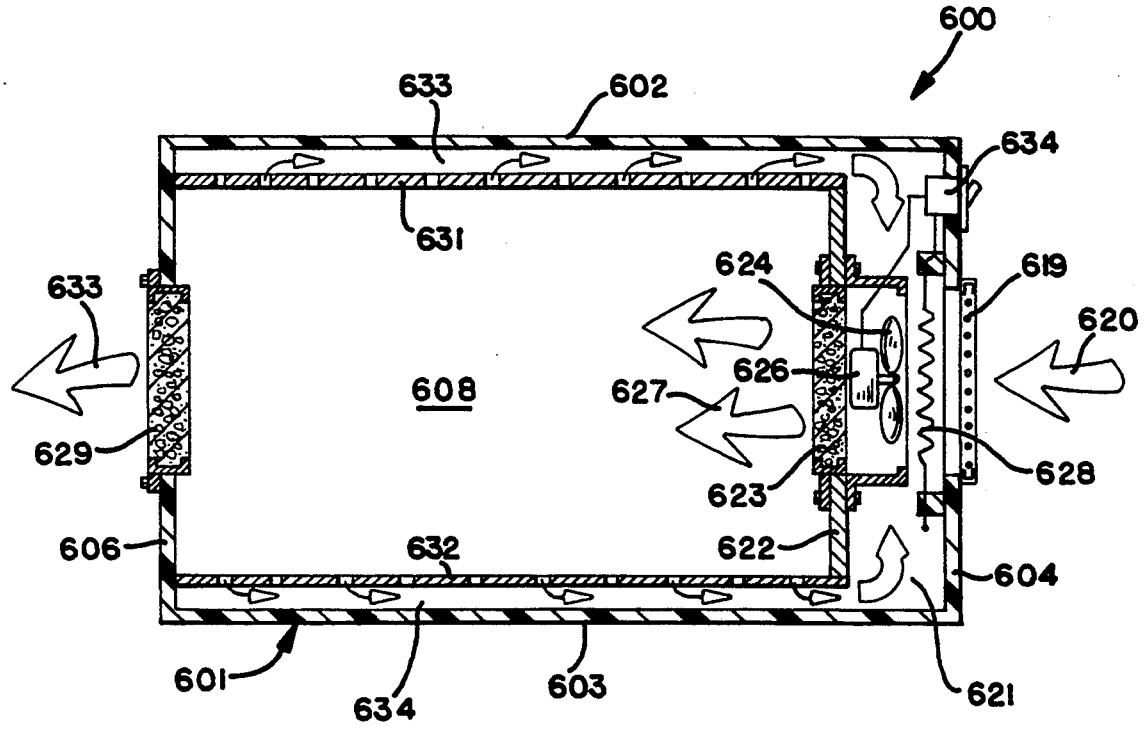
FIG. 26 is an enlarged sectional view taken along the line 26—26 of FIG. 23.

Dryer 600 has a box-shaped housing or chest, indicated generally at 601, comprising upright side walls 602 and 603 joined to air inlet end wall 604 and air outlet end wall 606. Walls 602, 603, 604 and 606 are joined to a generally flat bottom wall 607 to enclose drying chamber 608, as seen in FIG. 26. Walls 602–604, 606 and 607 can be rigid structures made of wood, plastic or paper materials. Flexible plastic, fabrics or canvas can be used for walls 602–604, 606 and 607. The top of drying chamber 608 is closed with a top member or cover, indicated generally at 609. Handle 611, attached to cover 609, can be used to open the cover and/or transport the dryer. Other handles and straps can be used to conveniently carry the dryer. Hinges 612 pivotally connect cover 609 to side wall 602. The opposite side of cover 609 accommodates latches 613 that secure cover 609 to side wall 603.

Housing 601 is connected to a movable carriage comprising a pair of wheels 614 and 616 rotatably mounted on the outlet end of housing 601. An elongated handle 617, attached to bottom wall 607, serves as a hand grip to facilitate the moving of drying 600 on a floor or surface 618. Handle 617 can be provided with extendible and retractable structures (not shown). Handle 617 can be a rigid one-piece structure attached to bottom wall 607.

Figure 25:
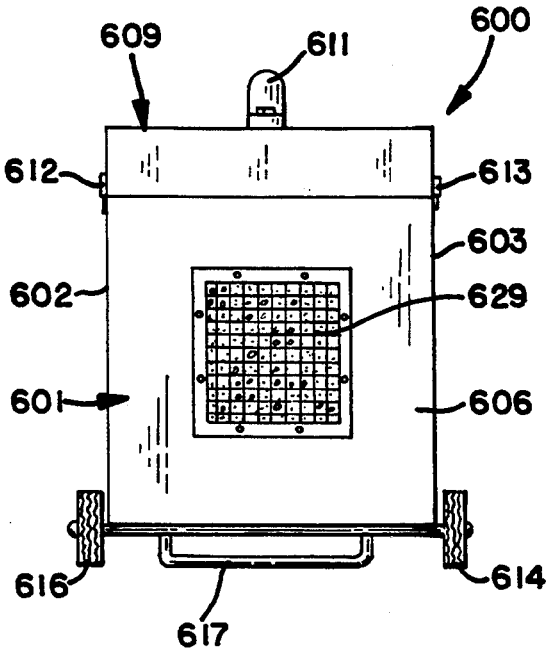
FIG. 25 is an end elevational view of the air outlet end of the dryer of FIG. 24.

As seen in FIGS. 25 and 26, end wall 606 has a central generally rectangular grill 619 which allows the in flow of air, indicated by arrows 620, into drying chamber 608. The air flows through grill 619 into mixing chamber 621, separated from drying chamber 608 with transverse wall 622. Filter 623, such as a charcoal filter, is mounted on wall 622 so that the air moving from mixing chamber 621 flows through filter 623, as indicated by arrows 627, into drying chamber 608. The air is moved with fan 624, driven by electric motor 626. Fan 624 can be a blade-type fan or an impeller fan that is operated to provide a continuous supply of air to drying chamber 608. Heater 628 is interposed between grill 619 and fan 624 to heat the air moving into fan 624 through filter 623 and into drying chamber 608. The air in drying chamber 608 flows through exit or exhaust filter 629, mounted in the mid-portion of air outlet walls 606. Filter 629 is preferably a charcoal filter or a filter that removes odors from the air discharged into the atmosphere.

Peg boards, or walls having holes 631 and 632, are located adjacent opposite sides of drying chamber 608. Wall 631 is located inwardly from side wall 602 to form a passage 633 to allow air to flow from drying chamber 608 back to mixing chamber 621. Peg board 632 is located inwardly from side wall 603 forming passage 634 to allow air to flow from drying chamber 608 into mixing chamber 621. The air in mixing chamber 621 is drawn by fan 624 back into drying chamber 608 thereby recirculating air from drying chamber 608 through mixing chamber 621 back into drying chamber 608. The recirculation of the air increases the moisture content of the air and improves the drying effectiveness and heat conservation efficient. Part of the air in drying chamber 608 is recirculated back to mixing chamber 621. The remaining portion of the air is directed through filter 629 into the atmosphere, as indicated by arrows 623.

Figure 24:
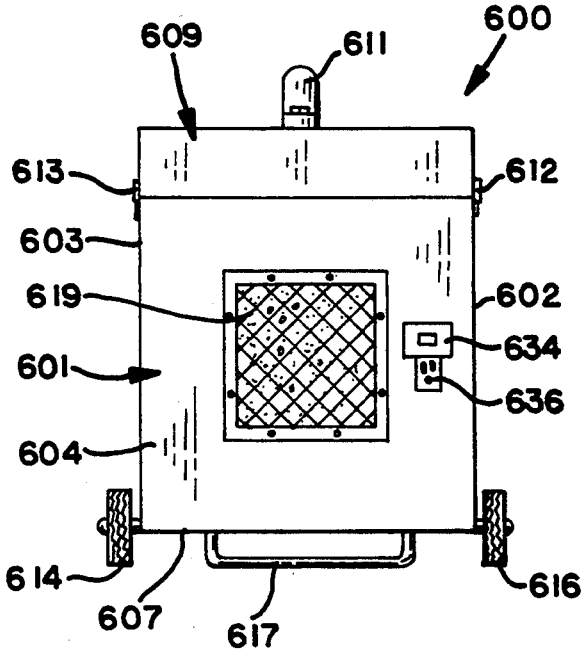
FIG. 24 is an end elevational view of the air inlet end of the dryer of FIG. 23.

Electric motor 626 and heater coil 628 are electrically connected to switch 634 mounted on end wall 604. As seen in FIG. 24, an electrical plug receptacle 636 is mounted on end wall 604 below switch 634. The controls for motor 626 and heater 628 can include a timer and thermostat (not shown), as disclosed by timer 103 and thermostat 108, as shown in FIG. 8.

While there has been shown and described preferred embodiments of the dryer of the invention, it is understood that changes in the structure and arrangement of structure can be made by those skilled in the art without departing from the invention. Changes in the locations, types and number of fans, heaters and ultraviolet lights and use of dehumidifiers in the dryers can be made by one skilled in the art which are equivalent to the claimed structure. The dryer can be vented to the outdoor environment with suitable ducts in lieu of exhaust filters. The invention is defined in the following claims.

I claim:

1. A dryer for articles comprising: housing means having an internal drying chamber for accommodating articles, door means movably mounted on the housing means for movement to an open position to permit access into the drying chamber and to a closed position to enclose the drying chamber, wall means within said housing providing an air mixing chamber, said wall means having first and second openings to allow air to flow from the air mixing chamber into the drying chamber and out of the drying chamber into the air mixing chamber, heater means located adjacent said first opening for heating air, first fan means located within the air mixing chamber operable to move air through said heater means and first opening into the drying chamber, second fan means located within the air mixing chamber operable to draw air from the drying chamber and air mixing chamber and discharge air through at least one opening to the environment outside of the dryer, charcoal filter means mounted on the housing means covering said opening to remove odors from the air flowing through said filter means, said housing means having at least one opening into the drying chamber to allow outside air to flow into the drying chamber, said filter means extending across said opening into the drying chamber to remove odors from the air flowing into the drying chamber, and control means for the heater means and first and second fan means operable to connect the heater means and first and second fan means to a source of power whereby the first fan means moves air through the heater means so that the air is heated and discharged as hot air into the drying chamber and the second fan means draws air from the drying chamber and air mixing chamber and discharges air to the environment outside of the dryer, said air in the drying chamber circulating and recirculating within the drying chamber to remove moisture from the articles within the drying chamber.

2. The dryer of claim 1 including: ultraviolet light means within said drying chamber, and control means for connecting the ultraviolet light means to a source of electric power whereby the ultraviolet light means emits ultraviolet light which reduces contaminants within the drying chamber.

3. The dryer of claim 2 wherein: the ultraviolet light means comprises a pair of light fixtures attached to the wall means, each light fixture having an ultraviolet lamp.

4. The dryer of claim 2 wherein: the control means includes a first switch operable to connect and disconnect the ultraviolet light means with the power source and a second switch operable in response to the opening and closing of the door means to connect and disconnect the ultraviolet light means with the power source, said ultraviolet light means being connected to the power source when the door means is closed.

5. The dryer of claim 1 wherein: the control means includes timer means for connecting the heater means and fan means to the power source for a selected period of time.

6. The dryer of claim 5 wherein: the control means includes a first ON/OFF switch connected to the timer means and heater means, and a second ON/OFF switch connected to the timer means and fan means.

7. The dryer of claim 1 including: light means attached to the wall means operable to emit light into the drying chamber when the door means is open, and control means associated with the door means operable to connect the light means to an electric power source when the door means is open and disconnect the light means from the power source when the door means is closed.

8. The dryer of claim 1 including: casing means having an internal chamber located within the drying chamber, tubular means mounted on the casing means open to the internal chamber and drying chamber adapted to accommodate articles to be dried, and third fan means mounted on the casing means operable to move air from the drying chamber through the internal chamber and tubular means to dry the articles thereon.

9. The dryer of claim 8 including: means having air passages mounted on the casing means for allowing air to flow out of the internal chamber into the drying chamber.

10. The dryer of claim 8 wherein: the third fan means comprises a plurality of fans operable to move air from the drying chamber into the internal chamber and through said tubular means.

11. The dryer of claim 8 wherein: the casing means includes a top wall and a side wall, means mounting the tubular means on the top wall, and means mounting the third fan means on said side wall.

12. The dryer of claim 1 wherein: the housing means has upright walls with inside portions around the drying chamber and members attached to said inside portions for supporting holders for the articles.

13. The dryer of claim 12 wherein: the members are peg boards.

14. The dryer of claim 1 wherein: said housing has a back wall with at least one opening open to the drying chamber and the environment outside of the dryer to allow air to flow into the drying chamber.

15. The dryer of claim 1 including: a boot dryer located within the drying chamber, said boot dryer having a casing with an internal chamber, tube means mounted on the casing means having a passage open to the internal chamber and drying chamber, ultraviolet light means within the internal chamber adapted to emit ultraviolet light into the internal chamber and tube means, and means for moving air through said chamber and tube means to dry articles retained on the tube means.

16. A dryer for articles comprising: housing means having an internal drying chamber for accommodating articles, means to permit access into the drying chamber to allow articles to be placed within the drying chamber, wall means within said housing providing an air mixing chamber, said wall means having a first opening to allow air to flow from the air mixing chamber into the drying chamber and a second opening to allow air to flow out of the drying chamber into the air mixing chamber, heater means for heating air, first means operable to move air through said heater means and first opening into the drying chamber, second means operable to draw air from the drying chamber through the second opening and discharge air to the environment outside of the dryer, said housing means having at least one opening to the air mixing chamber to allow air to be discharged from the air mixing chamber to the environment outside of the dryer.

17. The dryer of claim 16 including: control means for the heater means and first and second means operable to connect the heater means and first and second means to a source of power whereby the first means moves air through the heater means so that the air is heated and discharged as hot air into the drying chamber and the second means draws air from the drying chamber and discharges air to the environment outside of the dryer, said air in the drying chamber circulating and recirculating within the drying chamber to remove moisture from the articles within the drying chamber.

18. The dryer of claim 17 wherein: the control means includes a first switch operable to connect and disconnect the ultraviolet light means with the power source and a second switch operable in response to the means to permit access to the drying chamber to connect and disconnect the ultraviolet light means with the power source, said ultraviolet light means being connected to the power source when the drying chamber is closed.

19. The dryer of claim 17 wherein: the control means includes timer means for connecting the heater means and first and second means to the power source for a selected period of time.

20. The dryer of claim 19 wherein: the control means includes a first ON/OFF switch connected to the timer means and heater means, and a second ON/OFF switch connected to the timer means and first and second means.

21. The dryer of claim 16 including: ultraviolet light means within said drying chamber, and control means for connecting the ultraviolet light means to a source of electric power whereby the ultraviolet light means emits ultraviolet light which reduces contaminants within the drying chamber.

22. The dryer of claim 21 wherein: the ultraviolet light means comprises a pair of light fixtures attached to the wall means, each light fixture having an ultraviolet lamp.

23. The dryer of claim 16 wherein: the means to permit access into the drying chamber includes door means movably mounted on the housing means for movement between open and closed positions, and light means attached to the wall means operable to emit light into the drying chamber when the door means is open, and control means associated with the door means operable to connect the light means to an electric power source when the door means is open and disconnect the light means from the power source when the door means is closed.

24. The dryer of claim 16 including: casing means having an internal chamber located within the drying chamber, tubular means mounted on the casing means open to the internal chamber and drying chamber adapted to accommodate articles to be dried, and means mounted on the casing means operable to move air through the internal chamber and tubular means to dry the articles thereon.

25. The dryer of claim 24 including: means having air passages mounted on the casing means for allowing air to flow out of the internal chamber into the drying chamber.

26. The dryer of claim 24 wherein: the means mounted on the casing means operable to move air comprises a plurality of fans operable to move air from the drying chamber into the internal chamber and through said tubular means.

27. The dryer of claim 26 wherein: the casing means has a top wall and a side wall, means mounting the tubular means on said top wall, and means mounting the fans on said side wall.

28. The dryer of claim 27 including: filter means for removing odors from the air mounted on the casing means covering openings in the side walls adjacent the fans whereby air moved by the fans flows through said filter means to remove odors from the air.

29. The dryer of claim 16 including: a boot dryer located within the drying chamber, said boot dryer having a casing with an internal chamber, tube means mounted on the casing means having a passage open to the internal chamber and drying chamber, ultraviolet light means within the internal chamber adaptor to emit ultraviolet light into the internal chamber and tube means, and means for moving air through said chamber and tube means to dry articles retained on the tube means.

30. The dryer of claim 16 including: opening means in the housing means to allow air to flow into the drying chamber, and filter means for removing odors from air covering the opening means whereby when air flows through the opening means and filter means, odors are removed from the air.

31. A dryer for articles comprising: housing means having a drying chamber for accommodating articles, casing means having a top wall, a side wall and an internal chamber located within the drying chamber, tubular means having passages open to the drying chamber and internal chamber for accommodating articles, means securing said tubular means to said top wall, fan means operable to move air through said internal chamber and passages of the tubular means to dry articles located on said tubular means, means mounting the fan means on said casing means, and control means operable to connect the fan means to a power source whereby the fan means operates to move air through said internal chamber and tubular means to dry articles located on said tubular means.

32. The dryer of claim 31 wherein: housing means having an opening connecting the drying chamber with the environment outside of the dryer, and filter means for removing orders from air covering said opening whereby when air flows through the filter means, doors are removed from the air.

33. The dryer of claim 31 wherein: the control means includes timer means operable to connect the fan means to the power source for a selected period of time.

34. The dryer of claim 31 including: heater means for heating air, and means for moving the heated air into the drying chamber.

35. The dryer of claim 31 including: means having air passages mounted on the casing means for allowing air to flow out of the internal chamber into the drying chamber.

36. The dryer of claim 31 wherein: the fan means comprises a plurality of fans operable to move air from the drying chamber into the internal chamber and through said tubular means.

37. The dryer of claim 31 including: ultraviolet light means within said drying chamber, and control means for connecting the ultraviolet light means to a source of electric power whereby the ultraviolet light means emits ultraviolet light which reduces contaminants within the drying chamber.

38. The dryer of claim 37 wherein: the ultraviolet light means comprises a pair of light fixtures attached to the wall means, each light fixture having an ultraviolet lamp.

39. A dryer for articles comprising: housing means having a drying chamber for accommodating articles, filter means for removing odors from air mounted on the housing means, first fan means for moving air from the drying chamber through said filter means externally of the dryer thereby removing odors from the air, casing means having an internal chamber located within the drying chamber, tubular means attached to the casing means having passages open to the drying chamber and internal chamber for accommodating articles, second fan means mounted on the casing means operable to move air through said internal chamber and tubular means to dry articles located on the tubular means, and control means operable to connect the second fan means to a power source whereby the second fan means operates to move air through said internal chamber and tubular means to dry articles located on the tubular means.

40. A dryer for articles comprising: housing means having a drying chamber for accommodating articles, casing means having an internal chamber located within the drying chamber, tubular means attached to the casing means having passages open to the drying chamber and internal chamber for accommodating articles, filter means for removing odors from air mounted on the casing means, fan means mounted on the casing means operable to move air through said internal chamber and tubular means to dry particles located on the tubular means and move air through the filter means to remove odors from the air, and control means operable to connect the fan means to a power source whereby the fan means operates to move air through the internal chamber and tubular means to dry articles located on the tubular means and through filter means to remove odors from the air.

41. The dryer of claim 31 including: ultraviolet light means within the internal chamber for emitting ultraviolet light through the tubular means to destroy contaminants on articles mounted on the tubular means.

42. A dryer for articles comprising: housing means having an internal drying chamber for accommodating articles, means to permit access into the drying chamber to allow articles to be placed within the drying chamber, wall means within said housing providing an air mixing chamber, said wall means having a first opening to allow air to flow from the air mixing chamber into the drying chamber and at least one second opening to allow air to flow out of the drying chamber into the air mixing chamber, heater means for heating air, means operable to move air through said heater means and into the drying chamber and drawing air from the mixing chamber and discharging air from the drying chamber into the environment outside of the dryer, said housing means having a first opening into the air mixing chamber to allow air to flow into the air mixing chamber and a second opening to allow air to be discharged from the drying chamber into the environment outside of the dryer, and filter means covering the second opening to allow air to flow from the drying chamber into the environment outside of the dryer, said filter means having material to remove odors from the air flowing through the filter means.

43. The dryer of claim 42 wherein: the housing means includes flexible side walls, one of said side walls having means to selectively open and close said one of said side walls to allow access to the drying chamber.

44. The dryer of claim 42 including: duct means for carrying air from the means operable to move air to the drying chamber.

45. The dryer of claim 44 including: boot dryer means located within the drying chamber for drying articles, said duct means being connected to the boot dryer means to direct air into said boot dryer means thereby drying the articles on the boot dryer means.

46. A dryer for articles comprising: housing means having an internal drying chamber for accommodating articles, the housing means includes a top member, a bottom member and flexible side walls secured to the top member and bottom member, hook means attached to the top member for mounting the dryer on a support, means to selectively open and close one of said side walls to allow access to the drying chamber, and to allow articles to be placed within the drying chamber, wall means within said housing providing an air mixing chamber, said wall means having a first opening to allow air to flow from the air mixing chamber into the drying chamber and at least one second opening to allow air to flow out of the drying chamber into the air mixing chamber, heater means for heating air, means operable to move air through said heater means and into the drying chamber and drawing air from the mixing chamber and discharging air from the drying chamber into the environment outside of the dryer, said housing means having a first opening into the air mixing chamber to allow air to flow into the air mixing chamber and a second opening to allow air to be discharged from the drying chamber into the environment outside of the dryer.

47. A dryer for articles comprising: housing means having an internal drying chamber for accommodating articles, wheel means for supporting the dryer, a handle secured to the housing means to facilitate movement of the dryer, means to permit access into the drying chamber to allow articles to be placed within the drying chamber, wall means within said housing providing an air mixing chamber, said wall means having a first opening to allow air to flow from the air mixing chamber into the drying chamber and at least one second opening to allow air to flow out of the drying chamber into the air mixing chamber, heater means for heating air, means operable to move air through said heater means and into the drying chamber and drawing air from the mixing chamber and discharging air from the drying chamber into the environment outside of the dryer, said housing means having a first opening into the air mixing chamber and a second opening to allow air to be discharged from the drying chamber into the environment outside of the dryer.

48. A dryer for articles comprising: housing means having an internal drying chamber for accommodating articles, means to permit access into the drying chamber to allow articles to be placed within the drying chamber, wall means within said housing providing an air mixing chamber, said wall means having a first opening to allow air to flow from the air mixing chamber into the drying chamber and side walls within said drying chamber having a plurality of openings to allow air to flow from the drying chamber to the mixing chamber, heater means for heating air, means operable to move air through said heater means and into the drying chamber and drawing air from the mixing chamber and discharging air from the drying chamber into the environment outside of the dryer, said housing means having a first opening into the air mixing chamber to allow air to flow into the air mixing chamber and a second opening to allow air to be discharged from the drying chamber into the environment outside of the dryer.

49. A dryer comprising: a housing having a first chamber and a second chamber, an air inlet open to the first chamber, an air outlet open to the second chamber, filter means having material to remove odors from air located over said air outlet to remove odors from the air flowing through the filter, a dehumidifier located within the housing having a first coil in the first chamber to remove moisture from the air flowing into the first chamber and a second coil in the second chamber to heat the air flowing through the second chamber, first fan means in the first chamber for drawing outside air into the first chamber and second fan means for moving air from the first chamber to the second chamber and through said second coil and filter means to the environment outside of the dryer.

50. The dryer of claim 49 including: ultraviolet light means in the second chamber for decontaminating the air, second coil and filter means exposed to the ultraviolet light in the second chamber.

51. A dryer for articles comprising: housing means having an internal drying chamber for accommodating articles and first and second openings to the environment outside of the dryer means mounted on the housing means for movement to an open position to permit access into the drying chamber and to a closed position to enclose the drying chamber, wall means within said housing providing an air mixing chamber, said wall means having first and second openings to allow air to flow from the air mixing chamber into the drying chamber and out of the drying chamber into the air mixing chamber, heater means located adjacent said first opening for heating air, first fan means located within the air mixing chamber operable to move air through said heater means and first opening into the drying chamber, second fan means located within the air mixing chamber operable to draw air from the drying chamber and air mixing chamber and discharge air through said first opening to the environment outside of the dryer, first filter means mounted on the housing means covering said first opening to remove odors from the air flowing through said first filter means to the environment outside the dryer, said second opening being open to the drying chamber to allow outside air to flow into the drying chamber, second filter means extending across said second opening into the drying chamber to remove odors from the air flowing into the drying chamber, and control means for the heater means and first and second fan means operable to connect the heater means and first and second fan means to a source of power whereby the first fan means moves air through the heater means so that the air is heated and discharged as hot air into the drying chamber and the second fan means draws air from the drying chamber and air mixing chamber and discharges air to the environment outside of the dryer, said air in the drying chamber circulating and recirculating within the drying chamber to remove moisture from the articles within the drying chamber.

52. The dryer of claim 51 including: ultraviolet light means within said drying chamber, and control means for connecting the ultraviolet light means to a source of electric power whereby the ultraviolet light means emits ultraviolet light which reduces contaminants within the drying chamber.

53. The dryer of claim 51 wherein: said housing has a back wall, said back wall having said second opening open to the drying chamber and the environment outside of the dryer to allow air to flow into the drying chamber, and means mounting said second filter on said back wall whereby said second filter covers said second opening.

54. A dryer for articles comprising: casing means having an internal chamber and at least one opening connecting the internal chamber with the environment outside of the dryer, tubular means attached to the casing having passages open to the internal chamber and environment outside of the dryer for accommodating articles, filter means mounted on the casing means covering said opening to remove odors from air flowing through the filter means, fan means mounted on the casing means operable to move air through said tubular means into the internal chamber and through said filter means to the environment outside of the dryer to dry articles located on the tubular means and remove odor from the air, and control means operable to connect the fan means to a power source whereby the fan means operates to move air through said tubular means into the internal chamber and through said filter means to the environment outside of the dryer to dry articles located on said tubular means and remove odors from the air.

55. The dryer of claim 54 including: ultraviolet light means within the internal chamber for emitting ultraviolet light through the tubular means to destroy contaminants on articles mounted on the tubular means.

56. The dryer of claim 55 including: means mounted on said tubular means for reflecting ultraviolet light into the articles mounted on the tubular means.

57. The dryer of claim 54 wherein: said tubular means having longitudinal passages, ultraviolet light means located within said internal chamber in general alignment with the passages of the tubular means, and mirror means mounted on said tubular means in general alignment with the passages of the tubular means for reflecting ultraviolet light laterally of the passages of the tubular means into the articles mounted on the tubular means.

58. The dryer of claim 54 including: housing means having a chamber accommodating the tubular means and articles mounted thereon, said housing means having an opening connecting the chamber to the environment outside of the dryer, and filter means for removing odors from air covering said opening in the housing means whereby when air flows through said filter means, odors are removed from the air.

59. A dryer for articles comprising: casing means having an internal chamber, tubular means attached to the casing means having passages open to the internal chamber and environment outside of the dryer for accommodating articles, fan means mounted on the casing means operable to move air through said tubular means, internal chamber and said opening to dry articles located on the tubular means, said tubular means having longitudinal passages, ultraviolet light means located within said internal chamber in general alignment with the passages of the tubular means, mirror means mounted on said tubular means in general alignment with the passages of the tubular means for reflecting ultraviolet light laterally of the passages into the articles mounted on the tubular means, and control means operable to connect the fan means to a power source whereby the fan means operates to move air through said tubular means, internal chamber and through said opening in said casing means to dry articles located on said tubular means.

60. The dryer of claim 59 including: filter means mounted on the casing means over said opening to remove odors from air flowing through said filter means.

61. The dryer of claim 5 including: humidistat means operable in response to selected humidity of the air in the drying chamber to terminate the power to the timer means thereby shutting off the dryer.

62. The dryer of claim 19 including: humidistat means operable in response to selected humidity of the air in the drying chamber to terminate the power to the timer means thereby shutting off the dryer.

* * * * *